US007195221B2

(12) United States Patent
Maeda et al.

(10) Patent No.: US 7,195,221 B2
(45) Date of Patent: Mar. 27, 2007

(54) DEVICE WITH STABILIZATION LEG, IMAGE DISPLAY DEVICE, DEVICE MOUNT BLOCK, DEVICE DISPLAY SYSTEM, IMAGE DISPLAY DEVICE MOUNT BLOCK, IMAGE DISPLAY DEVICE DISPLAY SYSTEM, AND IMAGE DISPLAY DEVICE DISPLAYING METHOD

(75) Inventors: Takaki Maeda, Kanagawa (JP); Mitsuru Nakamura, Tokyo (JP); Toshihiro Matsuo, Tokyo (JP); Yasuyuki Seki, Saitama (JP)

(73) Assignee: Sony Corporation, Tokyo (JP)

( * ) Notice: Subject to any disclaimer, the term of this patent is extended or adjusted under 35 U.S.C. 154(b) by 86 days.

(21) Appl. No.: 10/515,857

(22) PCT Filed: May 29, 2003

(86) PCT No.: PCT/JP03/06772

§ 371 (c)(1),
(2), (4) Date: Jul. 5, 2005

(87) PCT Pub. No.: WO03/101167

PCT Pub. Date: Dec. 4, 2003

(65) Prior Publication Data

US 2005/0236535 A1 Oct. 27, 2005

(30) Foreign Application Priority Data

May 29, 2002 (JP) ..... 2002-155483
May 21, 2003 (JP) ..... 2003-143396

(51) Int. Cl.
*A47B 91/00* (2006.01)

(52) U.S. Cl. ..... 248/346.01; 248/678; 312/351.1

(58) Field of Classification Search ..... 248/346.01, 248/346.07, 678, 917; 312/7.2, 351.1, 351.2, 312/273
See application file for complete search history.

(56) References Cited

U.S. PATENT DOCUMENTS 4,194,452 A * 3/1980 Crowther et al. ..... 108/138

(Continued)

FOREIGN PATENT DOCUMENTS

JP 8-204348 8/1996

(Continued)

*Primary Examiner*—Ramon O Ramirez
(74) *Attorney, Agent, or Firm*—Frommer Lawrence & Haug LLP; William S. Frommer; Thomas F. Presson

(57) ABSTRACT

Disclosed are a device with stabilization base and a video display apparatus. The stabilization base is movable between a use position and a storage position, and is locked in the use position so that it would not easily move. When no problem occurs even if the stabilization base is moved, the locking of the stabilization base in the use position can be canceled easily. The stabilization base (4) is movable between the use position where it is projected outwards in relation to an outer edge of a grounding portion of an apparatus main body (2) and the storage position where it is stored on the inner side in relation to an outer edge of the apparatus main body. The stabilization base in the use position is immovably locked by lock means (10), (10) provided in the apparatus main body, and the locking by the lock means is canceled by pressing from the lower side or a lateral side.

14 Claims, 22 Drawing Sheets

U.S. PATENT DOCUMENTS 6,814,416 B2 * 11/2004 Helot et al. ..... 312/223.2
7,114,694 B2 * 10/2006 Li ..... 248/677

FOREIGN PATENT DOCUMENTS

JP 9-247586 9/1997
JP 11-97858 4/1999
JP 1 075 141 2/2001
JP 2002-134933 5/2002

* cited by examiner

DEVICE WITH STABILIZATION LEG, IMAGE DISPLAY DEVICE, DEVICE MOUNT BLOCK, DEVICE DISPLAY SYSTEM, IMAGE DISPLAY DEVICE MOUNT BLOCK, IMAGE DISPLAY DEVICE DISPLAY SYSTEM, AND IMAGE DISPLAY DEVICE DISPLAYING METHOD

TECHNICAL FIELD

The present invention relates to a device with stabilization base, a video display apparatus, a device mount base, a device exhibition system, a video display apparatus mount base, a video display apparatus exhibition system, and a video display apparatus exhibiting method. More particularly, the invention relates to a structure by which a stabilization base in a device, for example a video display apparatus, with the stabilization base can be stored when the stabilization base is not required, and to a system or method by which the video display apparatus with the stabilization base can be exhibited so that the height from a grounding surface to the center of a screen of the video display apparatus is set to be suited to video display characteristics without being affected by the size of the screen of the video display apparatus.

BACKGROUND ART

Among various devices (hereinafter referred to simply as "device") such as large-sized video display apparatuses and containing utensils (lockers and cabinets), there are those which would become instable and easily turn over when installed, due to a comparatively high position of the center of gravity thereof or due to too large a height in relation to the width of the grounding surface thereof.

Generally, the device which would become instable when installed is often provided with a stabilization base projected outwards in relation to the outer edge thereof, to stabilize the condition of the device and to prevent the device from easily turning over when the device is installed. The stabilization base is usually provided so as to project outwards from a grounding portion of the device, whereby the width of the grounding surface of the device is substantially enlarged and the device is prevented from easily turning over when installed.

FIG. 26 shows a video display apparatus a as an example of the device with stabilization base according to the related art. The video display apparatus a is provided with a stabilization base d at a grounding portion of an apparatus main body c including a screen b for displaying images.

The stabilization base d is in the state of projecting outwards in relation to the outer edge of a grounding portion e constituting the lowermost portion of the apparatus main body c. The stabilization base d is grounded on a floor surface, to function to substantially enlarge the width of the grounding surface of the video display apparatus a.

Therefore, in the video display apparatus a as above, the stabilization base d projecting outwards in relation to the outer edge of the grounding portion e constituting the lowermost portion of the apparatus main body c prevents the video display apparatus a from turning over to the side to which the stabilization base d projects, whereby the video display apparatus a can be installed in a stable condition.

Meanwhile, the conventional video display apparatus is sometimes mounted on a mount stand (mount base) for exclusive use which has a feeling of unity on a design basis, in exhibition for sale or in actual use thereof. Where the video display apparatus is mounted on a mount stand, the video display apparatus is supported in a stable condition by the mount stand, and there is no possibility of overturn of the video display apparatus, so that it is unnecessary to use the stabilization base. If the stabilization base is left projecting largely outwards in the condition where the video display apparatus is mounted on the mount stand, the stabilization base constitutes an obstacle and the feeling of unity between the video display apparatus and the mount stand is impaired.

Besides, containing utensils and the like devices having a stabilization base, other than the video display apparatus, also have the same problem as in the case of the video display apparatus.

In view of the this problem, it may be contemplated to adopt a structure in which the stabilization base can be moved between a use position where the stabilization base is projected from the front edge of the grounding portion of an apparatus main body or device main body and a storage position where the stabilization base is retracted from the front edge of the grounding portion, or a structure in which the stabilization base can be attached to and detached from the apparatus main body or device main body.

This ensures that in the case of exhibition or the like, by storing the stabilization base into the inside of the apparatus main body or device main body or by detaching the stabilization base from the apparatus main body or device main body, it is possible to prevent the stabilization base from constituting an obstacle and to obtain a shapely appearance. Further, where the mount stand and the video display apparatus are combined with each other, it is possible to maintain a feeling of unity on a design basis.

However, the structure in which the stabilization base can be stored into the inside of the apparatus main body or device main body or can be detached from the apparatus main body or device main body produces new problems as follows.

In the case where the stabilization base can be stored into the inside of the apparatus main body when not necessary, if some external force is exerted on the stabilization base located in its use position and the stabilization base is thereby shifted from the use position, the stabilization base cannot sufficiently display its function of stabilizing the installed condition of the apparatus main body.

Therefore, to prevent the stabilization base located in its use position from being moved easily, it is necessary to lock the stabilization base in the use position. However, in the case where the stabilization base is locked in the use position, there arises the problem that, at the time of moving the stabilization base having come to be unnecessary into its storage position, an additional labor is needed for unlocking the stabilization base, with the result of complicated work.

The present invention has been made in consideration of the above-mentioned problems. Accordingly, it is an object of the present invention to provide a structure, in relation to a device and a video display apparatus including a stabilization base for stabilizing the installed condition, in which the stabilization base movable between a use position and a storage position is locked in the use position so as to prevent the stabilization base from being easily moved, and the locking of the stabilization base in the use position can be easily canceled when no trouble occurs even if the stabilization base is moved.

DISCLOSURE OF INVENTION

In order to attain the above object, for example, a device with a stabilization base according to the present invention has the following structure. Specifically, the stabilization base is movable between a use position where the stabilization base is projected outwards in relation to a grounding portion of a device main body and a storage position where the stabilization base is stored in a storing portion provided in the grounding portion. The stabilization base is immovably locked in the use position by lock means provided in the device main body. The locking by the lock means is canceled by pressing from the lower side or from a lateral side.

In addition, a video display apparatus according to the present invention has the following structure. Specifically, a stabilization base is movable between a use position where the stabilization base is projected outwards in relation to a grounding portion of an apparatus main body and a storage position where the stabilization base is stored in a storing portion provided in the grounding position. The stabilization base is immovably locked in the use position by lock means provided in the apparatus main body. The locking by the lock means is canceled by pressing from the lower side or from a lateral side.

Therefore, in the device with a stabilization base according to the present invention, the video display apparatus according to the present invention and the like, when the lock means is pressed from the lower side or from a lateral side, the locking of the stabilization base in the use position is canceled. Accordingly, the stabilization base becomes movable from the use position to the storage position.

Furthermore, a video display apparatus exhibition system or exhibiting method according to the present invention has the following configuration. Specifically, a stabilization base movable between a use position where the stabilization base is projected outwards in relation to a grounding portion of a video display apparatus and a storage position where the stabilization base is stored in a storing portion provided in the grounding portion is provided at the grounding portion. A plurality of kinds of mount bases differing in the height from a grounding surface to a mount surface are prepared. Some of The plurality of mount bases are used in an appropriate combination, and the video display apparatus is mounted on the uppermost mount surface. Thus, the height from the grounding surface to the center of a screen of the video display apparatus is set to a desired height without being affected by the size of the screen of the video display apparatus.

Therefore, in the video display apparatus exhibition system or exhibiting method according to the present invention, the heights from the grounding surface to the centers of the screens of a plurality of video display apparatuses are made to be constant at the desired height. This holds true even in the case of the plurality of video display apparatuses differing in the height from the grounding surface to the center of the screen thereof.

BRIEF DESCRIPTION OF DRAWINGS

FIG. 8, together with FIGS. 9 to 11, sequentially shows the condition of each component part of the video display apparatus and the mount base in the case where the video display apparatus having been singly installed on a floor or the like is mounted onto the mount base, and this figure is a schematic vertical sectional view of the video display apparatus in the state of being mounted singly on the floor surface or the like.

BEST MODE FOR CARRYING OUT THE INVENTION

Now, some embodiments of the present invention will be described below, referring to the accompanying drawings.

First, a first embodiment of a video display apparatus, which is a device with a stabilization base, according to the present invention will be described using FIGS. 1 to 12.

The video display apparatus 1 is a large-sized video display apparatus including a screen (video display portion) having a diagonal size of not less than 40 inches, in which the screen 3 is provided at a front surface 2*a* of an apparatus main body 2. The video display apparatus 1 is, for example, a so-called rear projection type video display apparatus which includes a projector in the apparatus main body 2. Video images are projected onto and displayed on the screen 3 from the rear side.

Incidentally, the video display apparatus 1 is not limited to the above-mentioned rear projection type video display apparatus. The video display apparatus 1 may be a video display apparatus with a flat apparatus main body such as a plasma display, a video display apparatus using a large-sized CRT, or the like. In addition, while the large-sized video display apparatus including a screen with a diagonal size of not less than 40 inches has been mentioned as an example of the video display apparatus 1, the object to which the present invention is applied is not limited to the large-sized video display apparatus having such a large screen.

In the following description, when a description is made of the front, rear, upper, lower, left or right directions, the side where the screen 3 of the apparatus main body 2 is provided is deemed as the front side, the opposite side is deemed as the rear side. The upper, lower, left and right directions as viewed from a person facing the screen 3 are deemed directly as the upper, lower, left and right directions (this applies also to another application example and a second embodiment which will be described later).

The video display apparatus 1 is provided with a stabilization base 4 to substantially enlarge the width in the front-rear direction of a lower surface 2*c* constituting a grounding surface. The stabilization base 4 thus stabilizes the installed condition of the video display apparatus 1 and prevents the video display apparatus 1 from turning over to the front side. The stabilization base 4 is provided at the lower end (grounding portion) of the apparatus main body 2. Therefore, when the video display apparatus 1 is installed directly on a floor or the like, the stabilization base 4 is projected forwards in relation to the outer edge of the apparatus main body 2. Thus, the stabilization base 4 substantially enlarges the width in the front-rear direction of the grounding surface of the video display apparatus 1, stabilizes the installed condition of the video display apparatus 1, and prevents the video display apparatus 1 from turning over.

Figure 1:
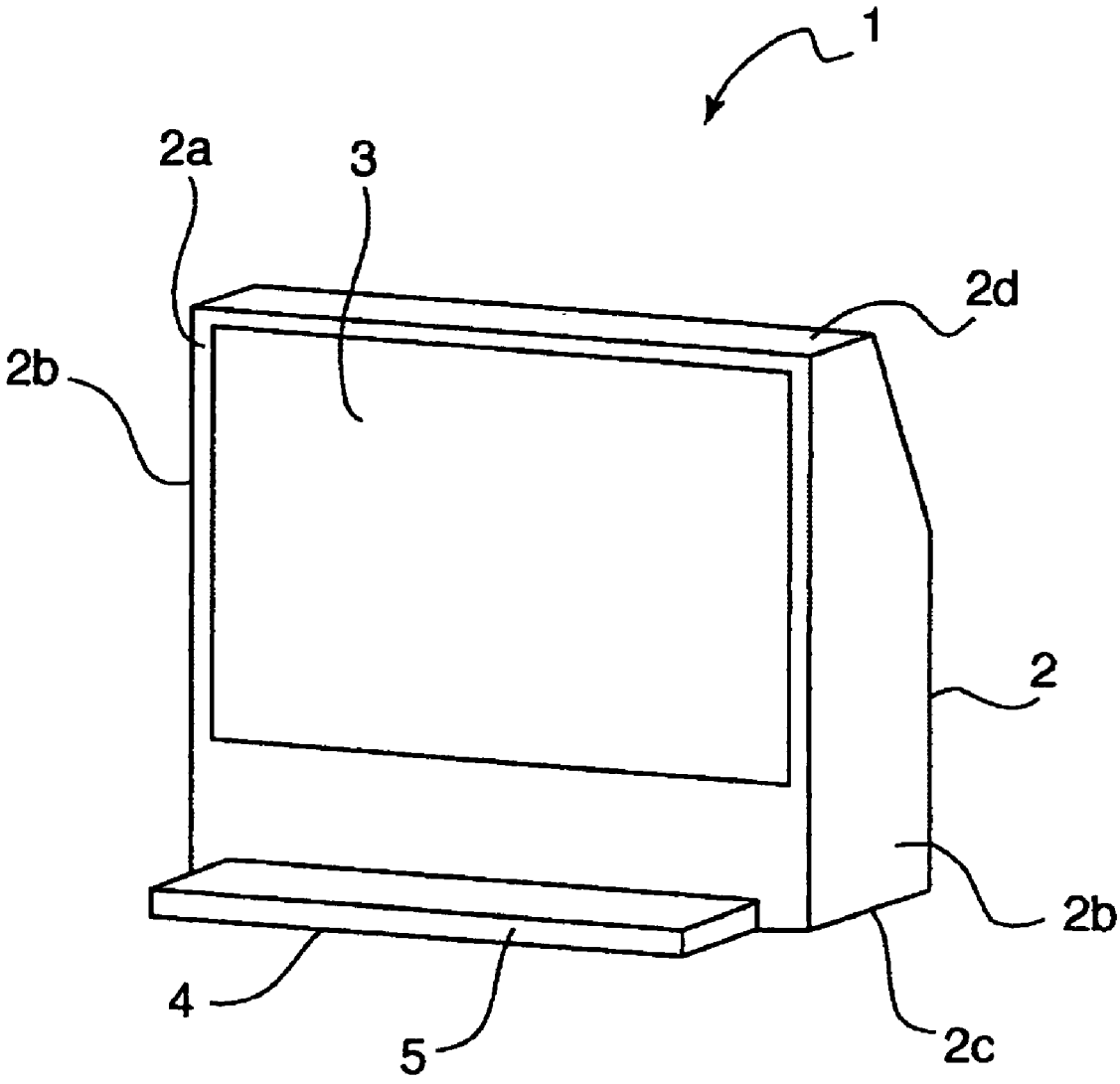
FIG. 1, together with FIGS. 2 to 15, illustrates a first embodiment of the present invention, and is a perspective view showing the entire part of a video display apparatus.
Figure 2:
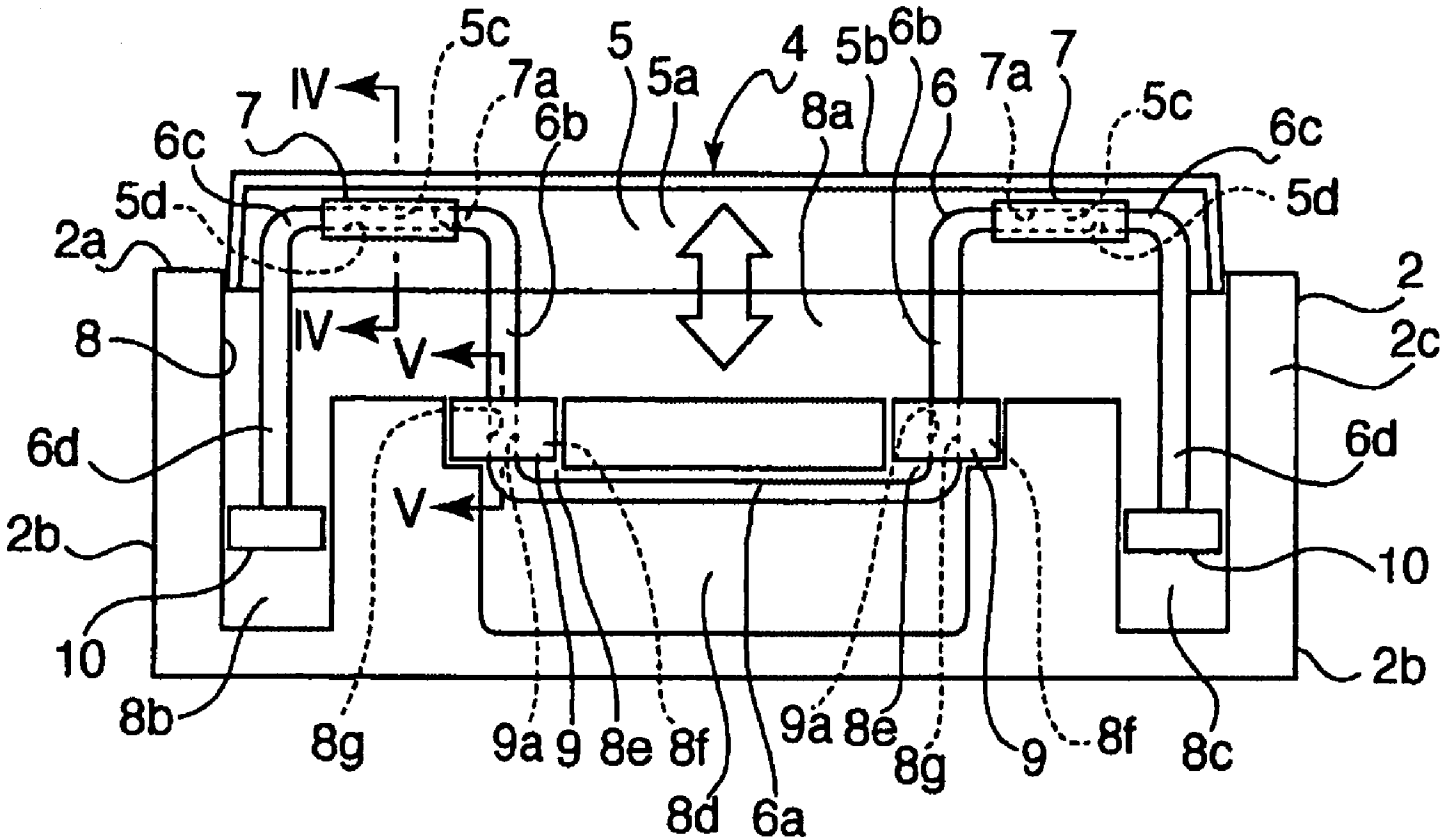
FIG. 2 is a bottom view of the video display apparatus in the condition where a stabilization base is located in a use position.
Figure 3:
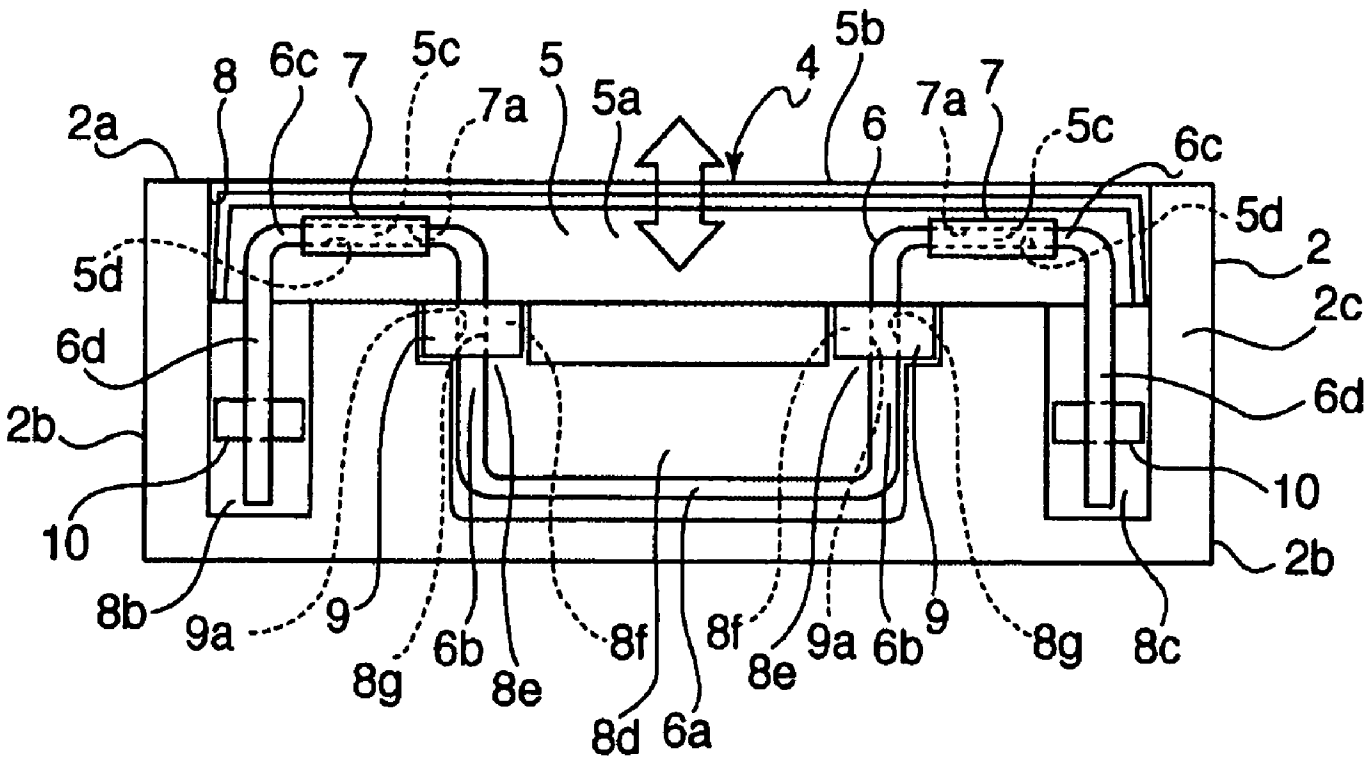
FIG. 3 is a bottom view of the video display apparatus in the condition where the stabilization base is located in a storage position.

As shown in FIGS. 2 and 3, the stabilization base 4 includes a plate-like base main body 5 elongate in the left-right direction, and a pipe frame 6 for supporting the base main body 5.

The base main body 5 is in the shape of a laterally elongate trapezoid in which the size in the left-right direction is slightly larger at a rear end portion than at a front end portion, as viewed in the vertical direction. Besides, as shown by the vertical section in FIG. 4, the base main body 5 includes an upper portion wall 5*a*, and a peripheral wall 5*b* so formed as to project downwards in relation to the front edge and the left and right side edges of the upper portion 5*a*. With the upper portion wall 5*a* and the peripheral wall 5*b* thus provided, the base main body 5 is in a wedge-like shape in which the vertical thickness is larger at the rear end than at the front end, as viewed in the left-right direction.

As shown in FIGS. 2 and 3, the pipe frame 6 is bent at an angle of 90° a plurality of times in the form of a crank, and is shaped to be symmetrical on the left and right sides. Specifically, the pipe frame 6 includes a central portion 6*a* extending in the left-right direction in a central area, supported portions 6*b*, 6*b* extending forwards respectively from the left and right ends of the central portion 6*a*, support portions 6*c*, 6*c* extending respectively outwards, i.e. leftwards or rightwards, from the front ends of the supported portions 6*b*,6*b*, and engaging portions 6*d*, 6*d* extending respectively rearwards from the outer ends, i.e. the left end or right end, of the support portions 6*c*, 6*c*. The pipe frame 6 is bent at 90° at boundary portions between the central portion 6*a* and the supported portions 6*b*, 6*b*, at boundary portions between the supported portions 6*b*, 6*b* and the support portions 6*c*, 6*c*, and at boundary portions between the support portions 6*c*, 6*c* and the engaging portions 6*d*, 6*d*.

As shown in FIGS. 2 and 3, the pipe frame 6 is fixed to the base main body 5 by fixing members 7, 7. The fixing members 7, 7 are attached to the upper portion wall 5*a* of the base main body 5 from the lower side.

Figure 4:
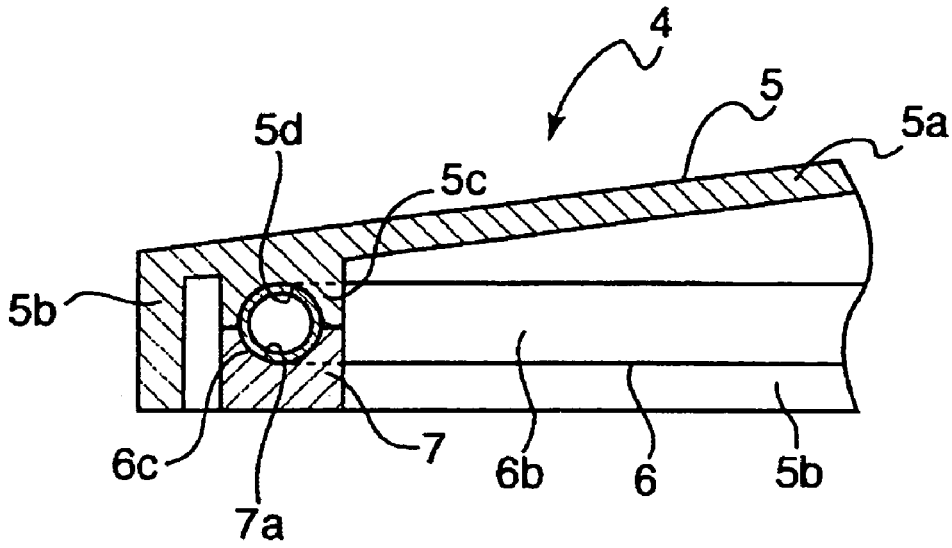
FIG. 4 is an enlarged sectional view taken along line IV—IV of FIG. 2.

As shown in FIG. 4, the fixing members 7, 7 are provided at their upper surfaces with roughly U-shaped fitting grooves 7*a*, 7*a* for fitting therein of the support portions 6*c*, 6*c* of the pipe frame 6. In addition, the portions to which the fixing members 7, 7 of the base main body 5 are fixed (hereinafter referred to as "fixing portions") 5*c*, 5*c* are projected downwards. The fixing portions 5*c*, 5*c* are provided in their lower surfaces with fitting grooves 5*d*, 5*d* which are roughly U-shaped like the fitting grooves 7*a*, 7*a* of the fixing members 7, 7.

When the fixing members 7, 7 are attached to the fixing portions 5*c*, 5*c* of the base main body 5 from the lower side, the support portions 6*c*, 6*c* of the pipe frame 6 are fitted between the fitting grooves 5*d*, 5*d* of the fixing portions 5*c*, 5*c* and the fitting grooves 7*a*, 7*a* of the fixing members 7, 7. Thus, the pipe frame 6 is clamped between the base main body 5 and the fixing members 7, 7, whereby the pipe frame 6 is fixed to the base main body 5 at two locations.

The lower surface 2*c* of the apparatus main body 2, which constitutes the grounding surface, is provided with a storing recessed portion 8. The storing recessed portion 8 is a portion into which the stabilization base 4 is entirely stored. The storing recessed portion 8 is divided into a plurality of portions according to the overall shape of the stabilization base 4.

The storing recessed portion 8 includes a front portion 8*a*, a left side portion 8*b* and a right side portion 8*c*, and a rear portion 8*d*. The front portion 8*a* is located near the front end of the lower surface 2*c* of the apparatus main body 2 and opens to the side of the front surface 2. The left side portion 8*b* and the right side portion 8*c* extend rearwards respectively from left and right portions of the front portion 8*a*. The rear portion 8*d* is slightly spaced rearwards from a central portion in the left-right direction of the front portion 8*a*. Incidentally, the rear portion 8*d* is slightly larger than the front portion 8*a* in the size in the front-rear direction, and the size in the left-right direction of the rear portion 8*d* is about ½ times that of the front portion 8*a*.

The front portion 8*a* and the rear portion 8*d* are connected to each other through the rear end of the front portion 8*a* and left and right end portions of the rear portion 8*d*. Slide guides 9, 9 are provided at the connected portions (hereinafter referred to as "connection portions") 8*e*, 8*e*. Besides, lock means 10, 10 which will be described later are disposed at positions on the rear sides of the left side portion 8*b* and the right side portion 8*c* of the storing recessed portion 8.

The slide guides 9, 9 are for attaching the stabilization base 4 to the apparatus main body 2, and for supporting the stabilization base 4 so that the stabilization base 4 is movable in the front-rear direction relative to the apparatus main body 2. The upper surfaces of the slide guides 9, 9 are provided with roughly U-shaped engaging grooves 9*a*, 9*a* for engagement with the supported portions 6*b*, 6*b* of the pipe frame 6. In addition, parts 8*f*, 8*f* of the connection portions 8*e*, 8*e* of the storing recessed portion 8 are projected downwards. The lower surfaces of the downwardly projected portions (hereinafter referred to as "projection portions") 8*f*, 8*f* are provided with engaging grooves 8*g*, 8*g* which are roughly U-shaped like the engaging grooves 9*a*, 9*a* in the slide guides 9, 9.

Figure 5:
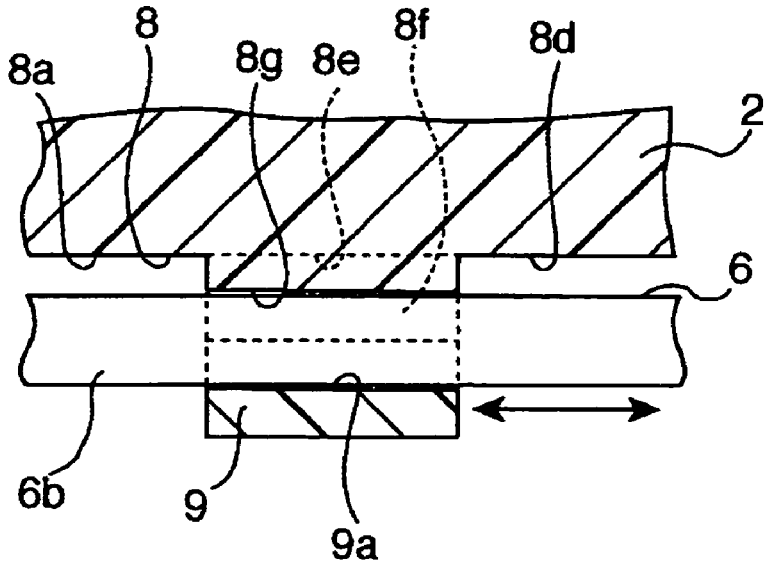
FIG. 5 is an enlarged sectional view taken along line V—V of FIG. 2.

By being attached to the projection portions 8*f*, 8*f* of the connection portions 8*e*, 8*e*, the slide guides 9, 9 support the supported portions 6*b*, 6*b* of the pipe frame 6 in a slidable state. This makes the stabilization base 4 movable in the front-rear direction relative to the apparatus main body 2. As shown in FIGS. 2 and 3, the slide guides 9, 9 are attached to the projection portions 8*f*, 8*f* of the connection portions 8*e*, 8*e* from the lower side. In this case, the supported portions 6*b*, 6*b* of the pipe frame 6 are located between the engaging grooves 8*g*, 8*g* in the projection portions 8*f*, 8*f* and the engaging grooves 9*a*, 9*a* in the slide guides 9, 9, as shown in FIG. 5. This results in that the pipe frame 6 is supported movably relative to the apparatus main body 2, and the stabilization base 4 is attached to the apparatus main body 2 at two locations.

As has been described above, the supported portions 6*b*, 6*b* of the pipe frame 6 are slidably supported by the slide guides 9, 9. Thus, the stabilization base 4 is made to be movable between a use position and a storage position. The use position is a position where the base main body 5 is projected forwards (outwards) in relation to the front surface (outer edge) 2*a* of the apparatus main body 2 (the condition shown in FIGS. 1 and 2). The storage position is a position where the base main body 5 is stored in the storing recessed portion 8 of the apparatus main body 2 and located on the inner side (inwards) in relation to the front surface 2*a* (the condition shown in FIG. 3).

Namely, as shown in FIG. 3, the stabilization base 4 in the storage position is not projected outwards relative to the front surface 2*a* of the apparatus main body 2. The stabilization base 4 in the storage position is wholly stored in the storing recessed portion 8 provided in the lower surface 2*c* of the apparatus main body 2.

Meanwhile, the use position of the stabilization base 4 is a position for preventing the apparatus main body 2 from turning over when the video display apparatus 1 is installed. Therefore, it is necessary to prevent the position of the stabilization base 4 from being easily moved when some external force is exerted thereon. Accordingly, the video display apparatus 1 is provided with the lock means 10, 10 for immovably locking the stabilization base 4 in the use position.

As shown in FIGS. 2, 3, and 8 to 11, the lock means 10, 10 are located on the rear side of the left side portion 8*b* and the right side portion 8*c* of the storing recessed portion 8. The lock means 10, 10 each include a rectangular holding hole 11, 11 opening to the lower side, engaging members 12, 12 slidably disposed in the holding holes 11, 11, and coil springs 13, 13 for urging the engaging members 12, 12 downwards.

As shown in FIGS. 8 to 11, the holding holes 11, 11 are so shaped that the inside diameter of an opening portion 11*a* is smaller than the inside diameter of the inside 11*b*. As a result, the opening portion 11*a* is provided with a projection edge 11*c* projecting in the direction of the center of the opening.

The engaging portions 12, 12 are in a rectangular columnar shape according to the shape of the holding holes 11, 11. The engaging members 12, 12 as a whole have an outer diameter substantially equal to the inside diameter of the opening portion 11*a*, and are provided at their upper end portions with anti-slip-off flanges 12*a*, 12*a*.

The engaging members 12, 12 are disposed to be movable in the vertical direction in the holding holes 11, 11. The coil springs 13, 13 are disposed in a contracted state between the engaging members 12, 12 and the upper surface of the holding holes 11, 11, whereby the engaging members 12, 12 are constantly urged downwards.

Figure 8:
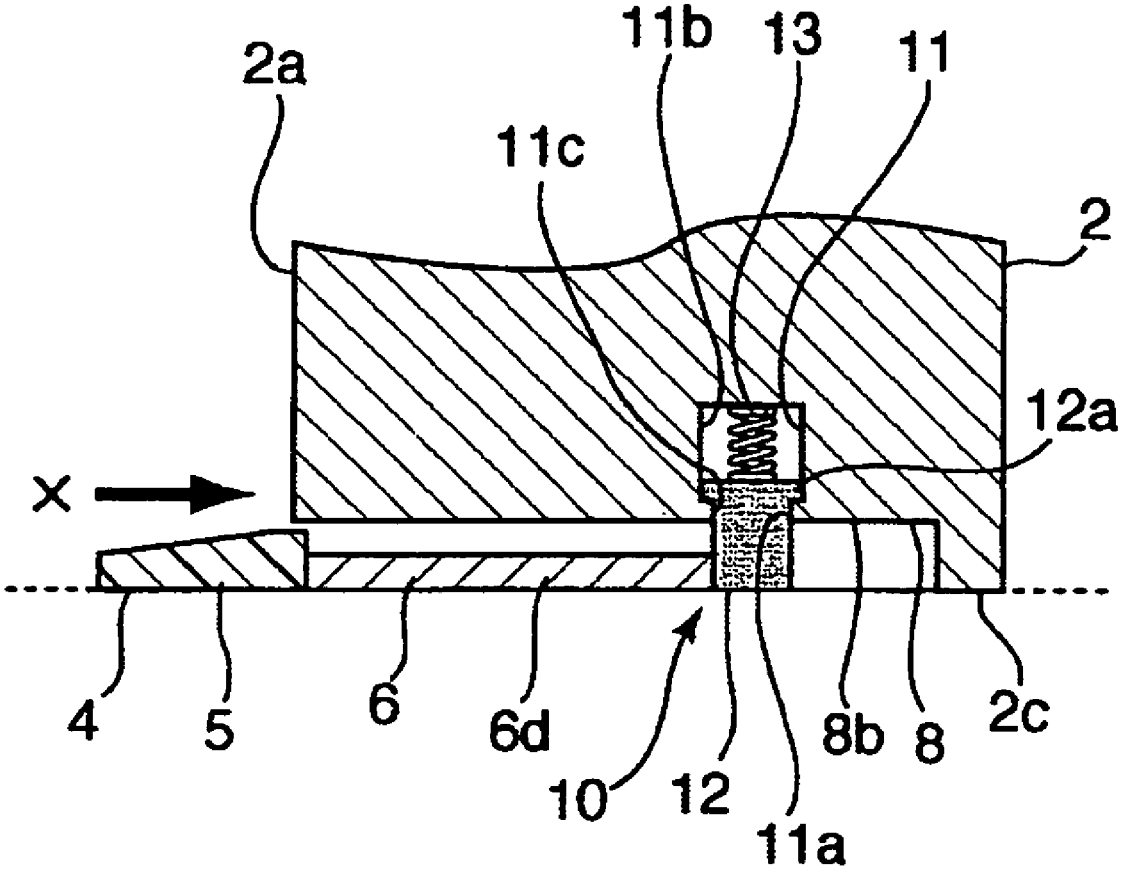
Figure 9:
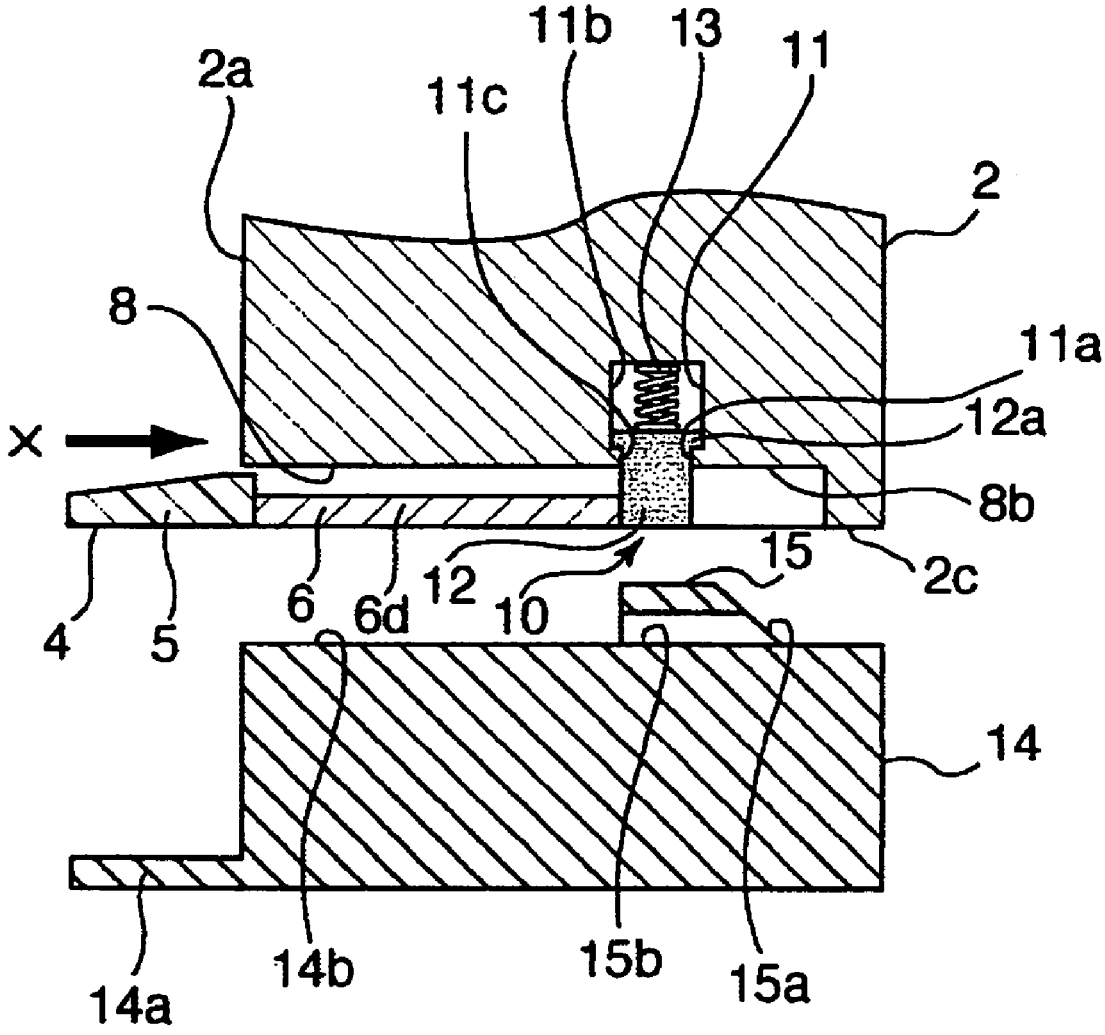
FIG. 9 is a schematic vertical sectional view showing the condition immediately before the video display apparatus is mounted on the mount base.

As shown in FIG. 8, the engaging members 12, 12 are urged downwards by the coil springs 13, 13, and is moved downwards until the anti-slip-off flange 12*a*, 12*a* comes into contact with the projection edge 11*c*, 11*c* of the holding holes 11, 11 from the upper side. Thus, an about ⅔ portion from the lower end of the engaging members 12, 12 is projected downwards from the holding holes 11, 11. In this instance, the anti-slip-off flange 12*a*, 12*a* makes contact with the projection edge 11*c*, 11*c* of the holding holes 11, 11 from the upper side, whereby slip-off of the engaging members 12, 12 from the holding holes 11, 11 is prevented.

The engaging members 12, 12 of the lock means 10, 10 are projected downwards at the positions on the rear side of the left side portion 8*b* and the right side portion 8*c* of the storing recessed portion 8. Therefore, the rear ends of the engaging portions 6*d*, 6*d* of the pipe frame 6 of the stabilization base 4 make contact with the projected engaging members 12, 12. Thus, a rearward movement of the stabilization base 4, i.e., a movement of the stabilization base 4 from the use position to the storage position is blocked (see FIGS. 2 and 8).

The locking of the stabilization base 4 in the use position by the lock means 10, 10 can be canceled by pressing the engaging members 12, 12 of the lock means 10, 10 upwards by some means. In the video display apparatus 1, the stabilization base 4 cannot be moved into the storage position where it is stored in the storing recessed portion 8, unless the locking of the stabilization base 4 in the use position by the lock means 10, 10 is canceled.

The following description is for illustrating an example in which the mount base on which to mount the video display apparatus 1 is provided with unlocking means. The unlocking means is provided for canceling the locking of the stabilization base 4 in the use position by the lock means 10, 10.

Figure 6:
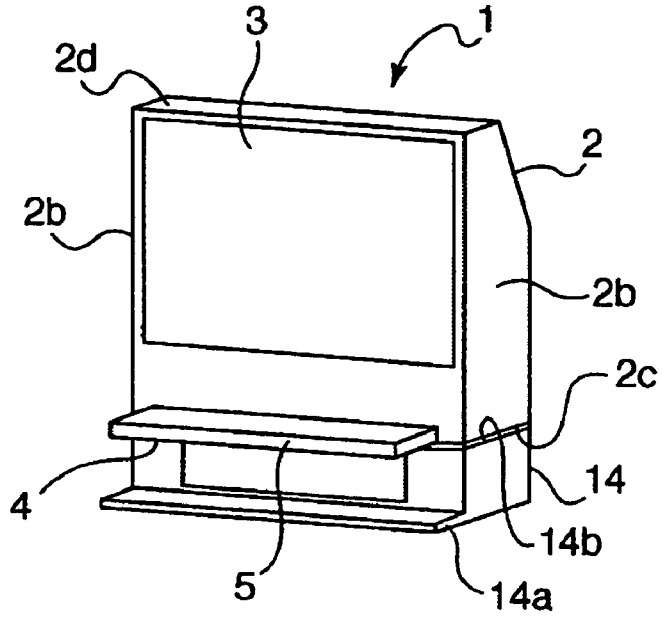
FIG. 6 is a perspective view showing the condition where the video display apparatus is mounted on a mount base, with the stabilization base in the use position.
Figure 7:
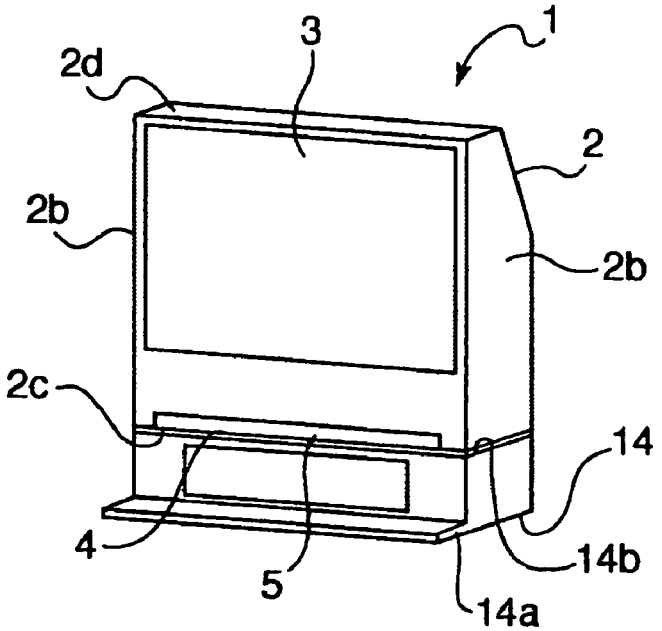
FIG. 7 is a perspective view showing the condition where the stabilization base is stored from the state shown in FIG. 6.

The video display apparatus 1 is not only used in the state of being installed singly on a floor or the like but also may be mounted on an exclusive-use mount base 14. The exclusive-use mount base 14 is formed to attain a feeling of unity on a design basis with the video display apparatus 1, as shown in FIGS. 6 and 7.

The mount base 14 is provided with a base portion 14*a* formed by projecting forwards a part of a lower portion thereof in a plate-like shape, for enlarging the width of the grounding surface in the front-rear direction. In addition, as shown in FIGS. 9 to 12, the mount base 14 includes pressing projections 15, 15 (only one of them is shown) provided on a mount surface 14*b* on which to mount the video display apparatus 1. Incidentally, the mount surface 14*b* of the mount base 14 and the lower surface 2*c* of the apparatus main body 2 of the video display apparatus 1 have substantially the same size.

The pressing projections 15, 15 are provided at positions corresponding to the positions of the lock means 10, 10 of the apparatus main body 1. When the video display apparatus 1 is mounted on the mount base 14, the pressing projections 15, 15 function to press the engaging members 12, 12 of the lock means 10, 10 upwards, thereby canceling the locking of the stabilization base 4 by the lock means 10, 10.

Besides, surfaces 15*a*, 15*a* on the rear side of the pressing projections 15, 15 are slant surfaces which are displaced rearwards as one goes downwards. In addition, the pressing projections 15, 15 are provided with engaging holes 15*b*, 15*b* opening to the front and rear sides (see FIG. 12).

Incidentally, the surfaces (hereinafter referred to as "rear-side slant surfaces") 15*a*, 15*a* on the rear side of the pressing projections 15, 15 are provided as slant surfaces, for the purpose of functioning as the so-called guide surfaces. The guide surfaces adjust the position of the apparatus main body 2 in the front-rear direction to the correct position when the video display apparatus 1 is mounted on the mount base 14. Specifically, when the position of the apparatus main body 2 is slightly deviated forwards relative to the mount base 14, the rear-side slant surfaces 15*a*, 15*a* make contact with a part (an edge portion on the rear side of the storing recessed portion 8) of the lower surface 2*c* of the apparatus main body 2. In this instance, the part of the lower surface 2*c* moves downwards by sliding on the rear-side slant surfaces 15*a*, 15*a*. Thus, the position of the apparatus main body 2 is moved rearwards, so that the positional relationship of the apparatus main body 2 to the mount base 14 is made appropriate.

Meanwhile, when the video display apparatus 1 is used in the state of being installed singly on a floor or the like without being mounted on the mount base 14, the stabilization base 4 is immovably locked in the use position by the lock means 10, 10 (see FIG. 8). When the video display apparatus 1 is mounted onto the mount base 14, the engaging members 12, 12 of the lock means 10, 10 are pressed from the lower side by the pressing projections 15, 15, and are moved upwards while contracting the coil springs 13, 13 (see FIGS. 9 and 10). With the engaging members 12, 12 thus moved upwards, the contact between the engaging members 12, 12 and the rear ends of the engaging portions 6*d*, 6*d* of the pipe frame 6 of the stabilization base 4 is cleared. Accordingly, the stabilization base 4 can be moved rearwards to be entirely stored into the storing recessed portion 8 (see FIGS. 10 and 11).

Figure 10:
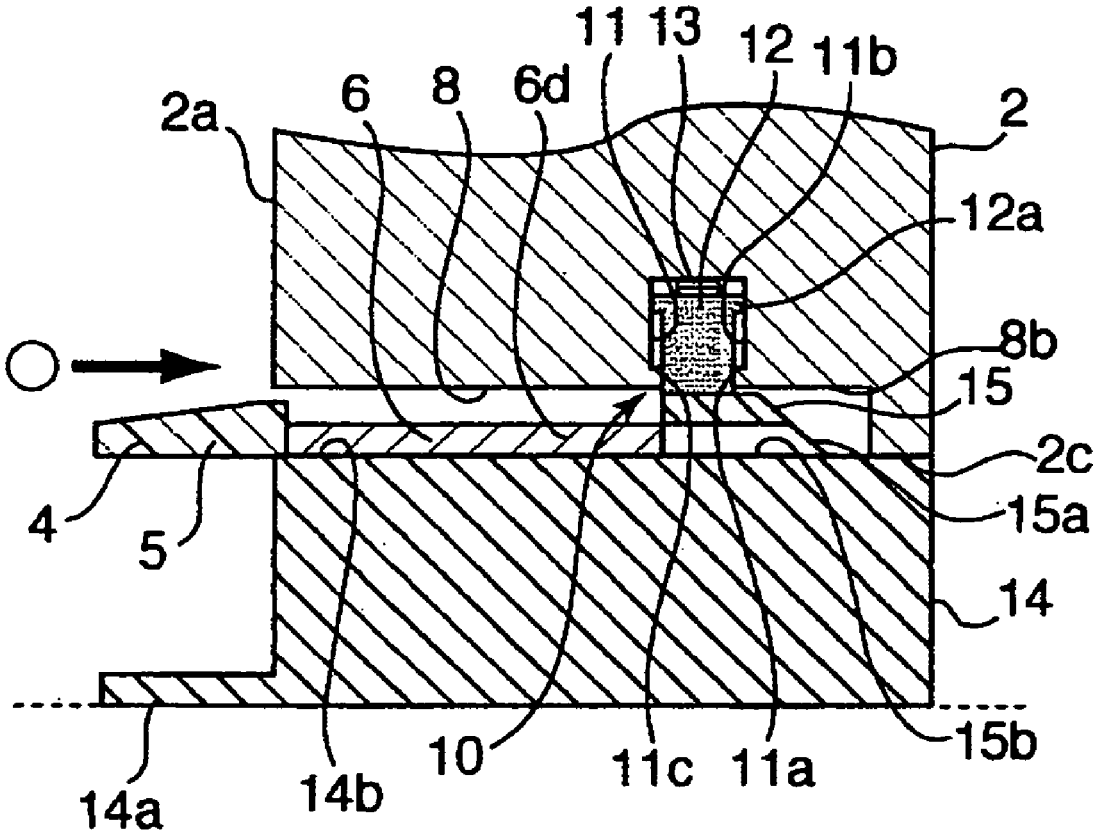
FIG. 10 is a schematic vertical sectional view showing the condition where the video display apparatus is mounted on the mount base and the stabilization base is in the use position.
Figure 11:
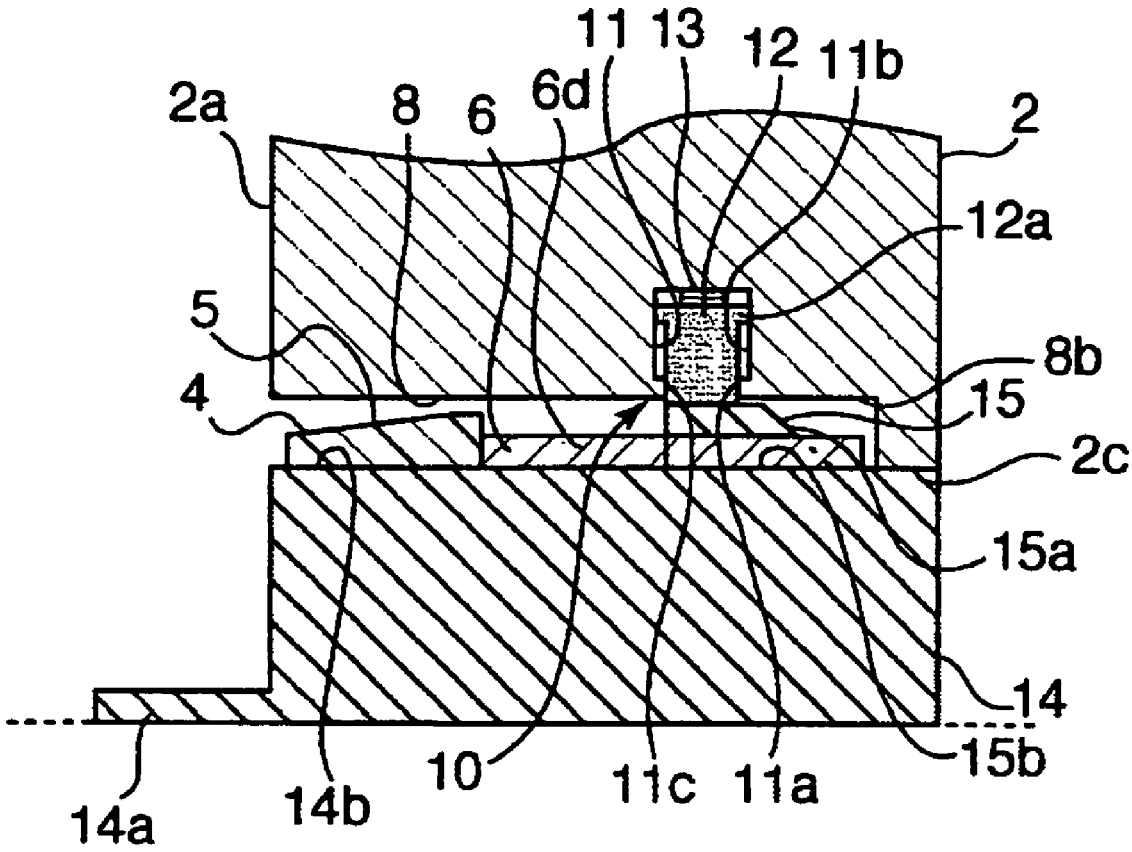
FIG. 11 is a schematic vertical sectional view showing the condition where the video display apparatus is mounted on the mount base and the stabilization base is moved into a storage position.
Figure 12:
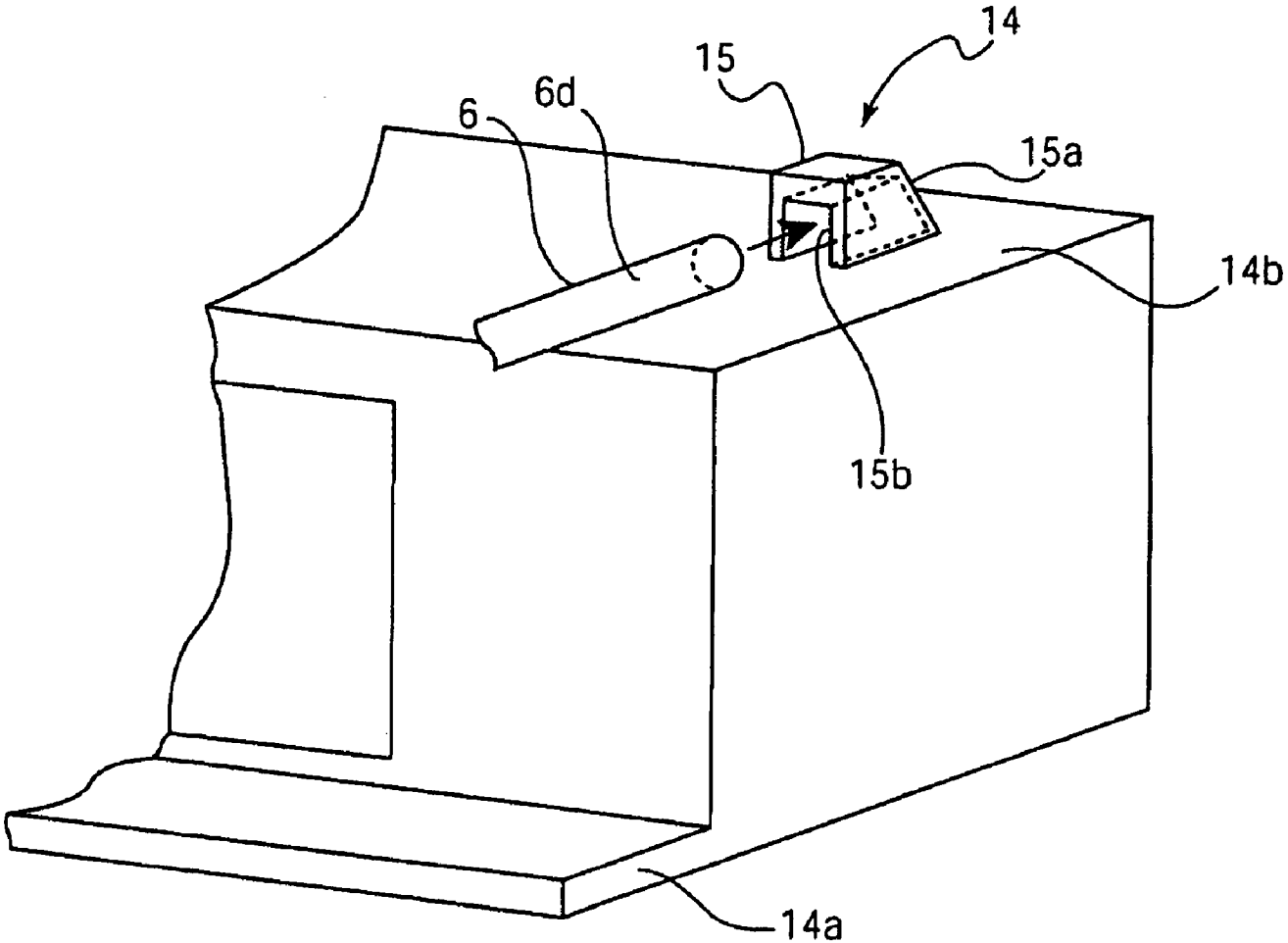
FIG. 12 is a perspective view schematically showing the relationship between an engaging portion of the stabilization base and the mount base.

When the video display apparatus 1 is mounted on the mount base 14, the locking of the stabilization base 4 in the use position is canceled and the stabilization base 4 is moved rearwards into the storage position where it is stored in the storing recessed portion 8 as sequentially shown in FIGS. 10 and 11, the engaging portions 6*d*, 6*d* of the pipe frame 6 are also moved rearwards. Then, the engaging portions 6*d*, 6*d* come into engagement with the engaging holes 15*b*, 15*b* in the pressing projections 15*b*, 15*b*, whereby the video display apparatus 1 and the mount base 14 are connected to each other. In the condition where the video display apparatus 1 and the mount base 14 are thus connected to each other, the video display apparatus 1 and the mount base 14 cannot be separated from each other, unless the stabilization base 4 is moved from the storage position to the use position.

Incidentally, the canceling of the locking of the stabilization base 4 in the use position may not necessarily be achieved by the pressing from the lower side of the pressing projections 15, 15. For example, a structure may be adopted in which the canceling of the locking is achieved by pressing from one of the front, rear, left, and right sides by appropriate means.

Besides, projections having substantially the same structure and same function as those of the pressing projections 15, 15 provided on the mount surface 14*b* of the mount base 14 in conformity with the positions of the lock means 10, 10 of the video display apparatus 1 may be provided at the upper surface 2*d* of the apparatus main body 2 of the video display apparatus 1. In this case, for example, when a plurality of video display apparatuses 1, 1, . . . are stacked, the locking by the lock means 10, 10 is canceled by the projections provided in the video display apparatus located at the lower position, in the same manner as in the case where the video display apparatus 1 is mounted on the mount base 14. Therefore, the stabilization bases 4 of the video display apparatuses 1 located at upper positions can each be moved into the storage position in the storing recessed portion 8, and the plurality of video display apparatuses 1, 1, . . . can be connected with each other. With the plurality of video display apparatuses 1, 1, . . . thus stacked and connected with each other, it is possible to arrange the screens 3, 3, . . . thereof in a matrix form and to utilize the whole part as a screen.

Figure 13:
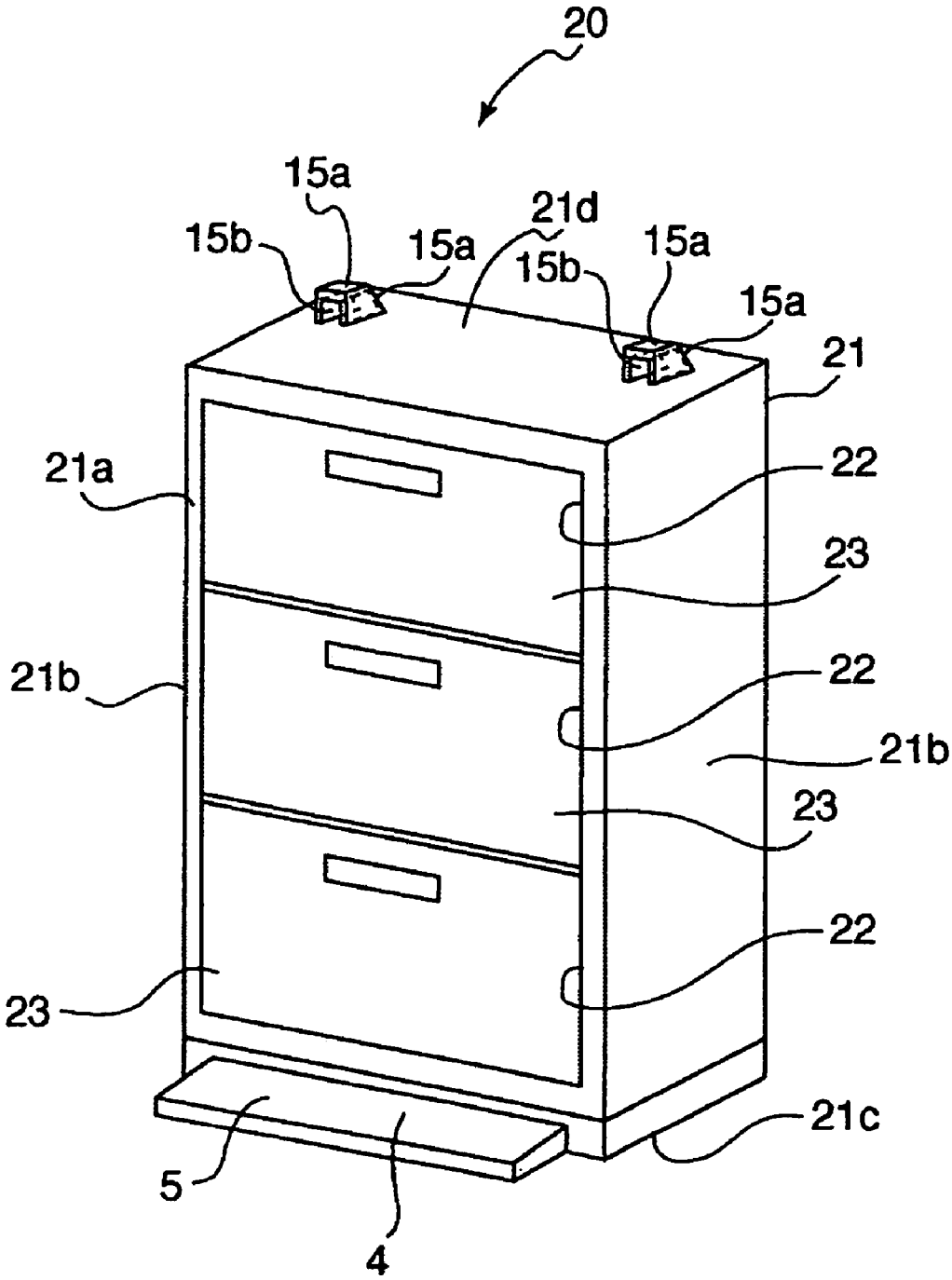
FIG. 13, together with FIGS. 14 and 15, illustrates another application example in the first embodiment of the present invention, and this figure is a perspective view showing the entire part of a cabinet.
Figure 14:
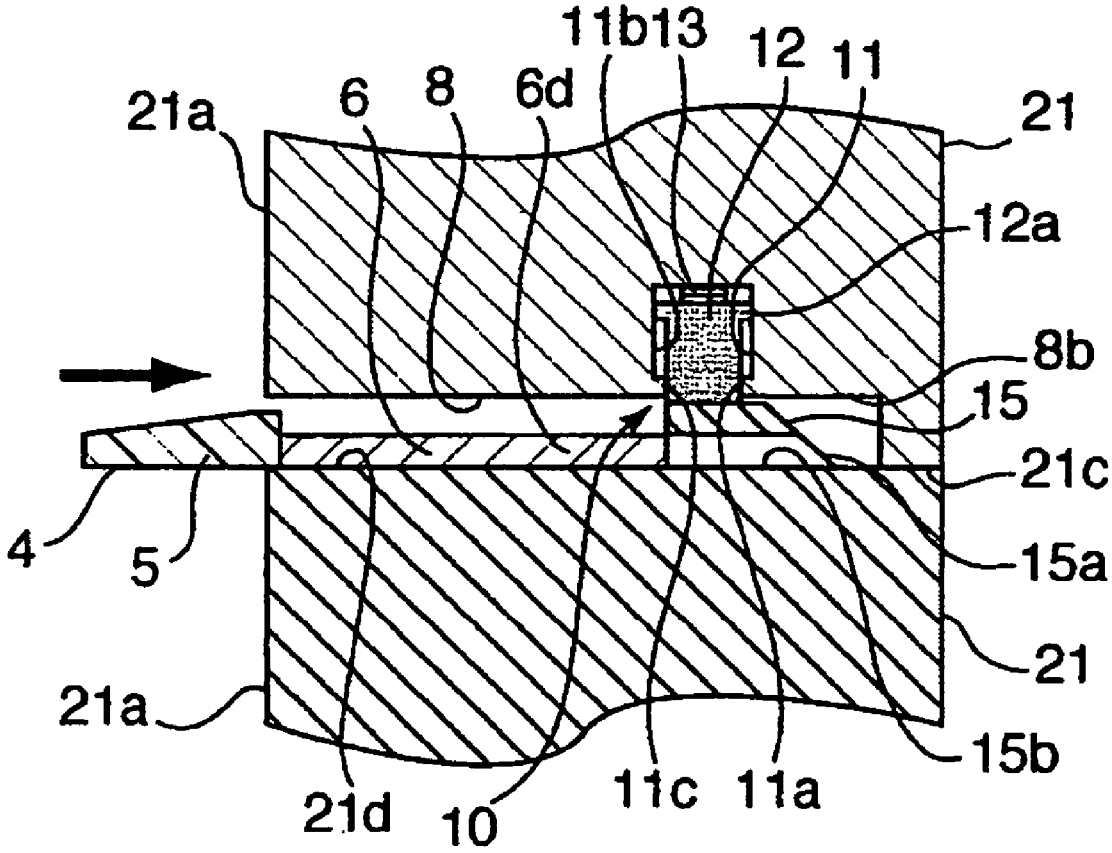
FIG. 14 is a vertical sectional view schematically showing an essential part of the condition where another cabinet is mounted on the cabinet and the stabilization base is in the use position.
Figure 15:
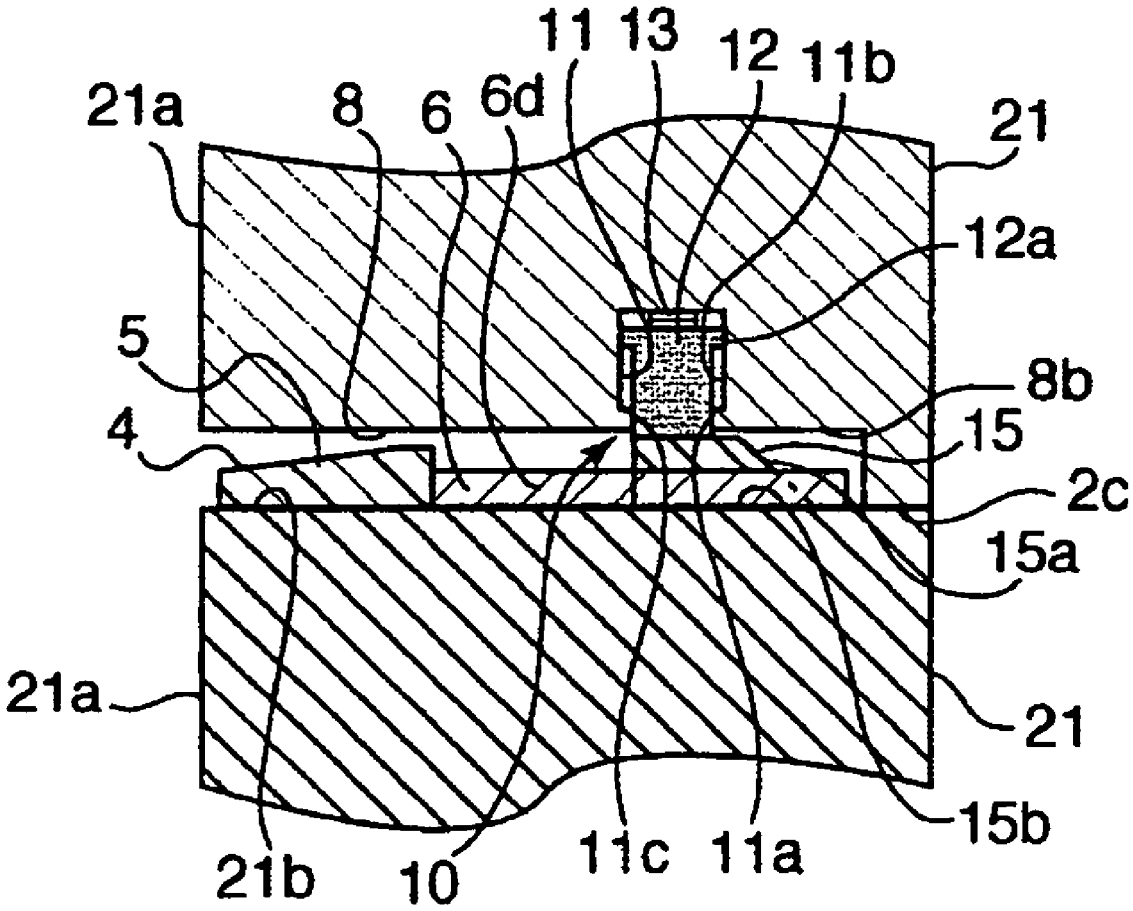
FIG. 15 is a vertical sectional view showing an essential part of the condition where another cabinet is mounted on the cabinet and the stabilization base is moved into the storage position.

FIGS. 13 to 15 illustrate an example in which the configuration of the stabilization base 4, the storing recessed portion 8, the lock means 10, 10 and the like shown in the video display apparatus 1 as above-described is applied to a containing utensil (hereinafter referred to as "cabinet") 20 which is one example of device with stabilization base. Incidentally, the containing utensil is not limited to the cabinet 20, and other articles such as a chest of drawers may also be adopted without any problems.

Incidentally, in the following description of individual component parts of the cabinet 20, those portions having the same configurations as the individual component parts of the video display apparatus 1 described above are denoted by the same symbols as used in the above description of the individual component parts of the video display apparatus 1, and detailed description thereof will be omitted.

As shown in FIG. 13, the cabinet 20 includes a device main body 21. A front surface 21*a* of the device main body 21 is provided with storing recessed portions 22, 22, 22 opening to the front side. Drawers 23, 23, 23 capable of being drawn out and pushed in are contained in the storing recessed portions 22, 22, 22.

The cabinet 20 is provided with a stabilization base 4 for substantially enlarging the width in the front-rear direction of a lower surface 21*c* of the device main body 21, which constitutes a grounding surface. Consequently, the stabilization base 4 stabilizes the installed condition of the cabinet 20 and prevents the cabinet 20 from turning over to the front side. The stabilization base 4 is provided at the lower end (grounding portion) of the device main body 21. When the cabinet 20 is installed directly on a floor or the like, the stabilization base 4 projects forwards in relation to an outer edge of the cabinet 20. The stabilization base 4 thus substantially enlarges the width in the front-rear direction of the lower surface 21*c*. Accordingly, the stabilization base 4 stabilizes the installed condition of the cabinet 20 and prevents the cabinet 20 from turning over.

The lower surface 21*c* of the device main body 21 is provided with a storing recessed portion 8. Incidentally, the lower surface 21*c* of the device main body 21 has quite the same structure as that of the lower surface 2*c* of the apparatus main body 2 of the video display apparatus 1.

In addition, an upper surface 21*d* of the cabinet 20 is provided with pressing projections 15, 15, in the same manner as in the mount base 14 which has been used for mounting the video display apparatus 1 thereon. The pressing projections 15, 15 are provided at positions corresponding to the positions of lock means 10, 10 provided in the storing recessed portion 8 in the lower surface 21*c* of the cabinet 20. For example, when another cabinet 20 is mounted on the cabinet 20, as shown in FIGS. 14 and 15, engaging members 12, 12 of the lock means 10, 10 of the cabinet 20 on the upper side are pressed from the lower side by the pressing projections 15, 15 on the upper surface 21*d* of the cabinet 20 on the lower side. Thus, the locking of the stabilization base 4 of the cabinet 20 on the upper side is canceled.

Namely, in the cabinet 20 also, when it is used in the state of being installed singly on a floor or the like, the stabilization base 4 is immovably locked in the use position by the lock means 10, 10. When the cabinet 20 is mounted onto another cabinet 20, the engaging members 12, 12 of the lock means 10, 10 are pressed from the lower side by the pressing projections 15, 15 of the cabinet 20 on the lower side. The engaging members 12, 12 are moved upwards while contracting coil springs 13, 13 (see FIG. 14). Thus, the contact between the engaging members 12, 12 and engaging portions 6*d*, 6*d* of the stabilization base 4 is cleared. Accordingly, the stabilization base 4 can be moved rearwards to be stored in the storing recessed portion 8 (see FIG. 15).

When the locking of the stabilization base 4 in the use position is canceled and the stabilization base 4 is moved rearwards into the storage position where it is stored in the storing recessed portion 8 as sequentially shown in FIGS. 14 and 15, the engaging portions 6*d*, 6*d* of the pipe frame 6 are also moved rearwards. Then, the engaging portions 6*d*, 6*d* are engaged with engaging holes 15*b*, 15*b* in the pressing projections 15, 15. Thus, the upper and lower cabinets 20, 20 are connected with each other. In the condition where the two cabinets 20, 20 are connected with each other, the cabinets 20, 20 cannot be separated from each other unless the stabilization base 4 is moved from the storage position to the use position.

Incidentally, in the cabinet 20 also, the canceling of the locking of the stabilization base 4 in the use position may not necessarily be achieved by the pressing from the lower side by the pressing projections 15, 15. For example, a structure may be adopted in which the canceling of the locking is achieved by pressing from one of the front, rear, left, and right sides by appropriate means.

Next, a second embodiment of the video display apparatus, which is an apparatus with stabilization base, according to the present invention will be described using FIGS. 16 to 23.

The stabilization base 4 shown in the first embodiment described above is moved between the use position and the storage position, relative to the apparatus main body 2 of the video display apparatus 1 or the device main body 21 of the cabinet 20. However, in the device with stabilization base and the video display apparatus according to the present invention, the movement of the stabilization base between the use position and the storage position is not limited to sliding.

A video display apparatus 30 according to the second embodiment of the device with stabilization base of the present invention to be described below includes a stabilization base so designed as to be moved between a use position and a storage position through turning.

Figure 16:
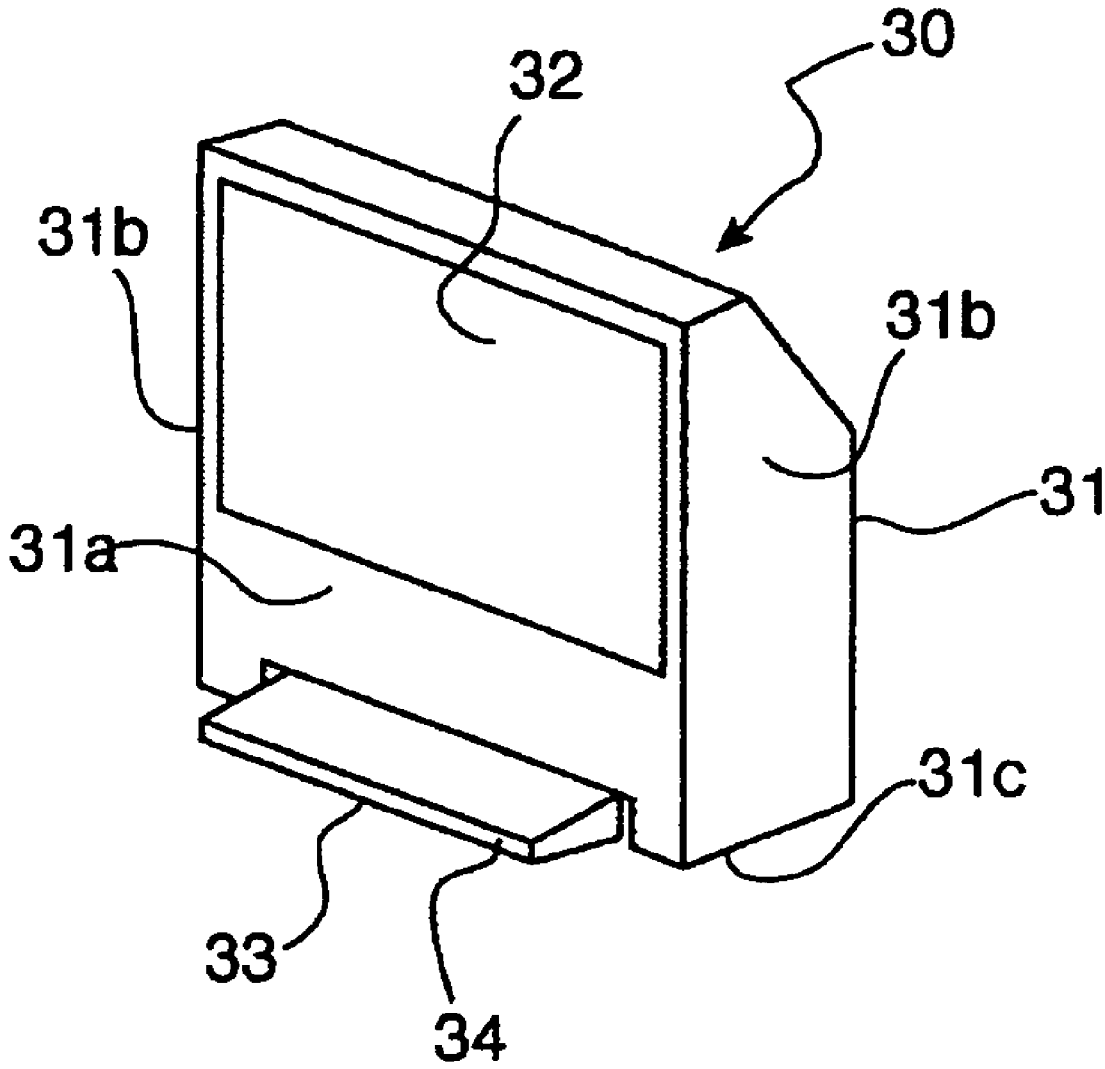
FIG. 16, together with FIGS. 17 to 23, illustrates a second embodiment of the present invention, and this figure is a perspective view showing the entire part of a video display apparatus.
Figure 17:
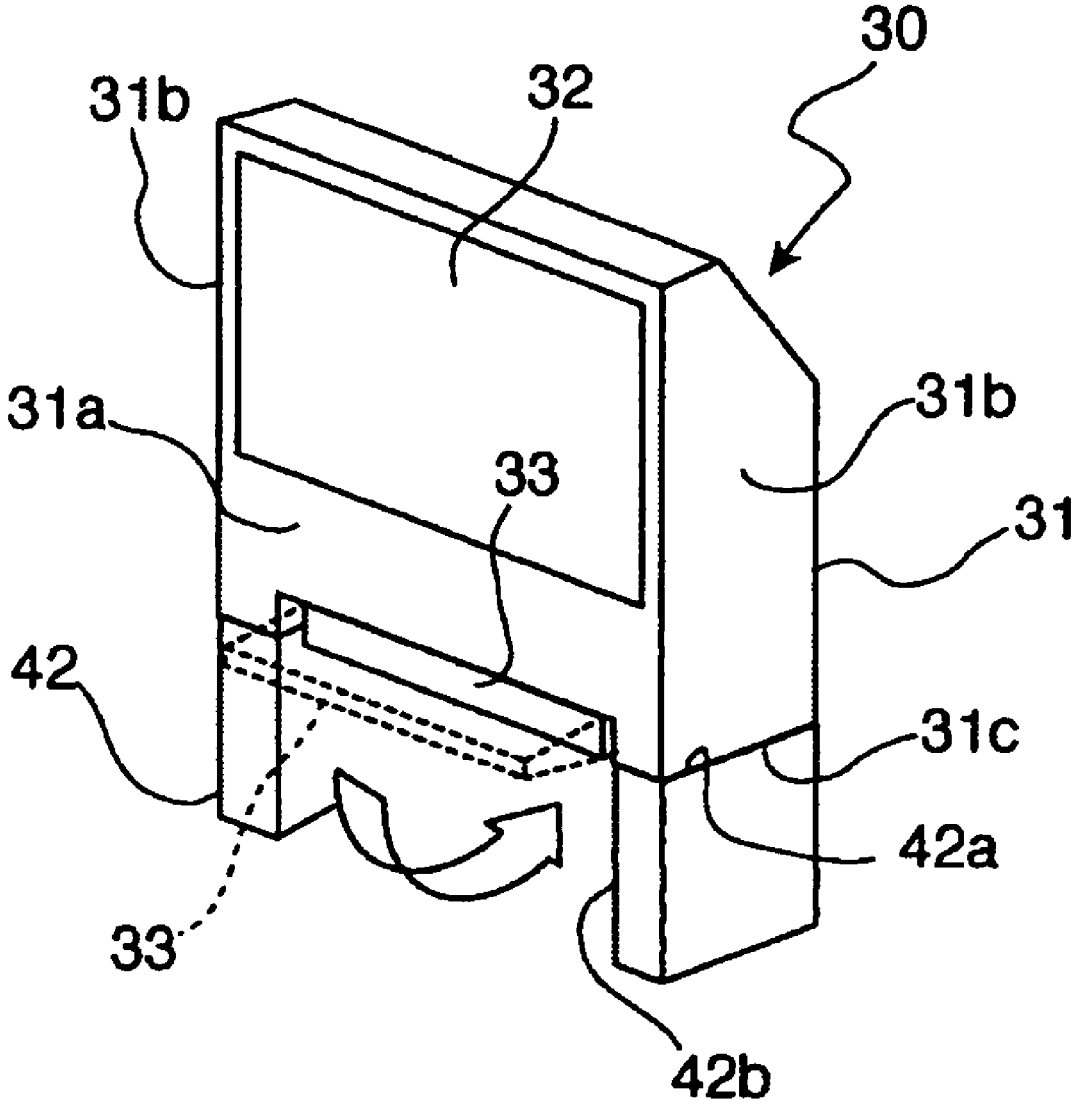
FIG. 17 is a perspective view showing the condition where the video display apparatus is mounted on a mount base.

As shown in FIGS. 16 and 17, the video display apparatus 30 is provided with a screen 32 at a front surface 31*a* of an apparatus main body 31. The video display apparatus 30 is a so-called rear projection type video display apparatus which includes a projector in the apparatus main body 2. Video images are projected onto and displayed on the screen 32 from the rear side, in the same manner as in the video display apparatus 1 shown in the first embodiment.

Incidentally, the video display apparatus 30 is not limited to the rear projection type video display apparatus. The video display apparatus 30 may be a video display apparatus with a flat apparatus main body such as a plasma display, a video display apparatus using a large-sized CRT, or the like. Besides, while a large-sized video display apparatus including a screen having a diagonal size of not less than 40 inches is shown, the apparatus in the present invention is not limited to the large-sized video display apparatus having such a large screen.

As shown in FIGS. 16 and 17, the video display apparatus 30 is provided with a stabilization base 33. The stabilization base 33 substantially enlarges the width in the front-rear direction of a lower surface 31*c* constituting a grounding surface. The stabilization base 33 thus stabilizes the installed condition of the video display apparatus 30 and prevents the video display apparatus 30 from turning over to the front side. The stabilization base 33 is provided at the lower end (grounding portion) of an apparatus main body 31. When the video display apparatus 30 is installed directly on a floor or the like, the stabilization base 33 projects forwards in relation to an outer edge of the apparatus main body 31. Thus, the stabilization base 33 substantially enlarges the width in the front-rear direction of the grounding surface of the video display apparatus 30. Accordingly, stabilization base 33 stabilizes the installed condition of the video display apparatus 30 and prevents the video display apparatus 30 from turning over.

Figure 18:
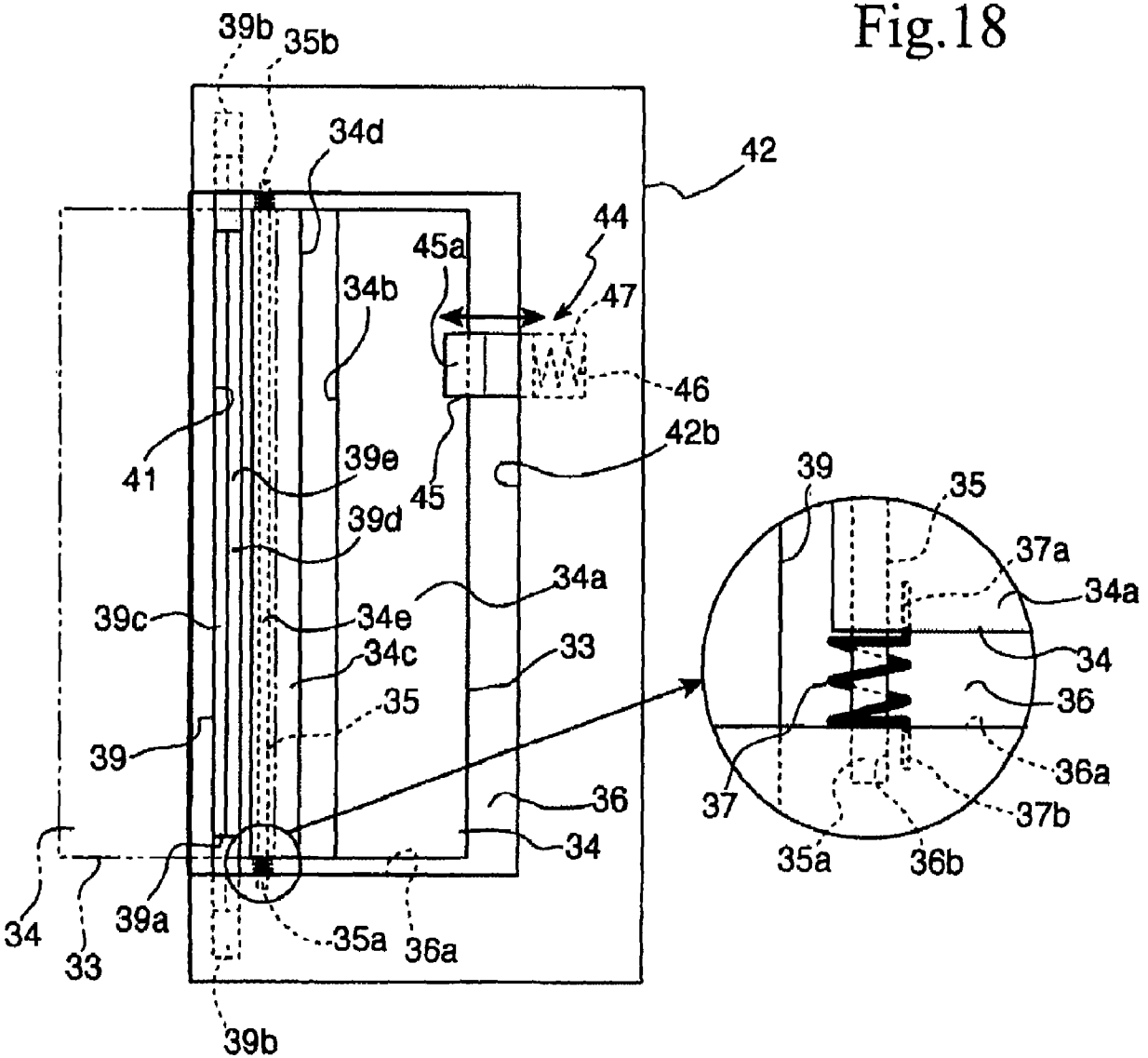
FIG. 18 shows the condition where the video display apparatus is mounted on the mount base, as viewed from the side of a grounding surface of the mount base.
Figure 19:
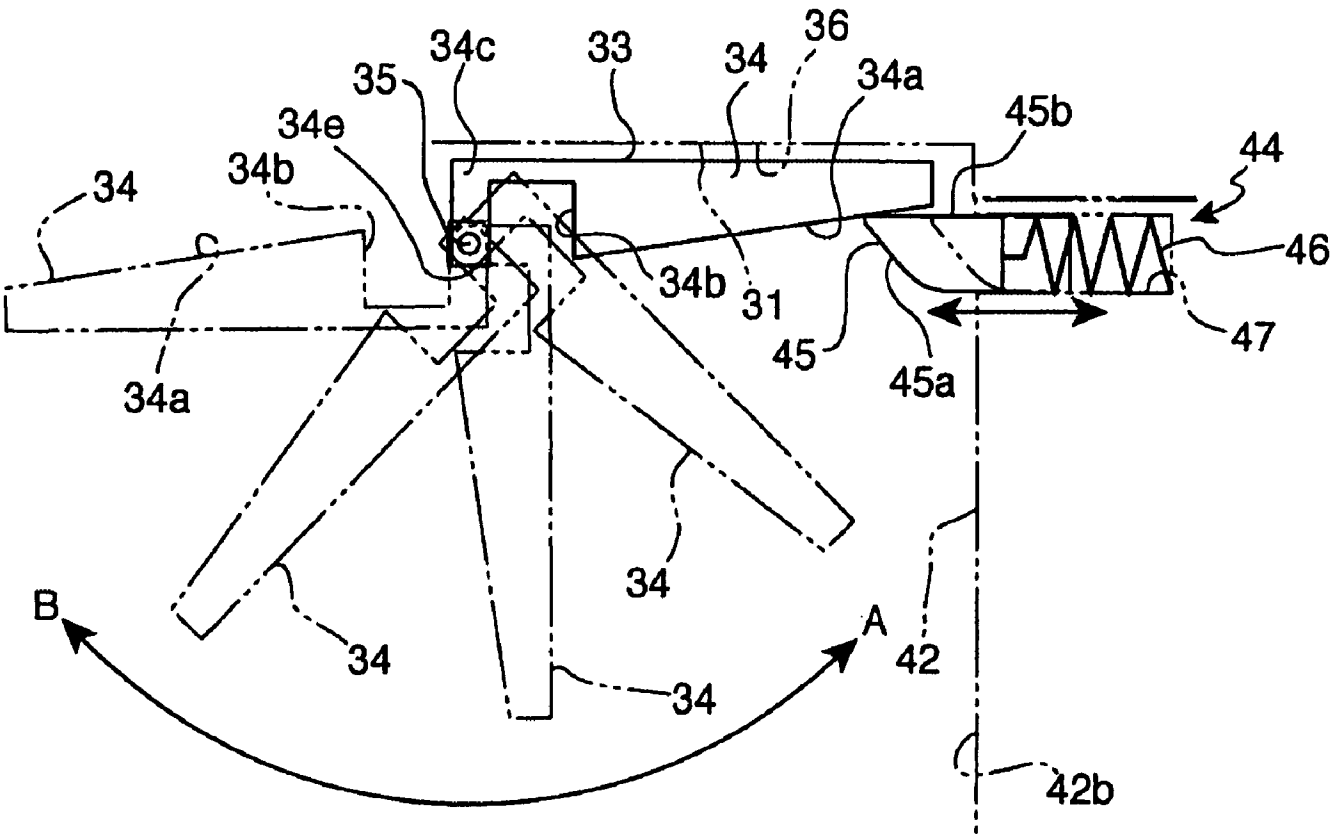
FIG. 19 is a side view schematically showing how the stabilization base is moved between a use position and a storage position.

As shown in FIGS. 18 and 19, the stabilization base 33 includes a plate-like base main body 34 elongate in the left-right direction, and a support shaft 35 for turnably supporting the base main body 34. The support shaft 35 is fixed to the base main body 34 in the state of being inserted through the base main body 34. The base main body 34 is supported to be turnable relative to the apparatus main body 31 through the support shaft 35.

A lower surface 31*c* of the apparatus main body 31, constituting a grounding surface, is provided with a storing recessed portion 36. The storing recessed portion 36 is a portion in which to store the stabilization base 33, and is formed in a shape according to the overall shape of the stabilization base 33. The storing recessed portion 36 is in a rectangular shape elongate in the left-right direction, and opens to the side of the front surface 31*a* of the apparatus main body 31.

Figure 20:
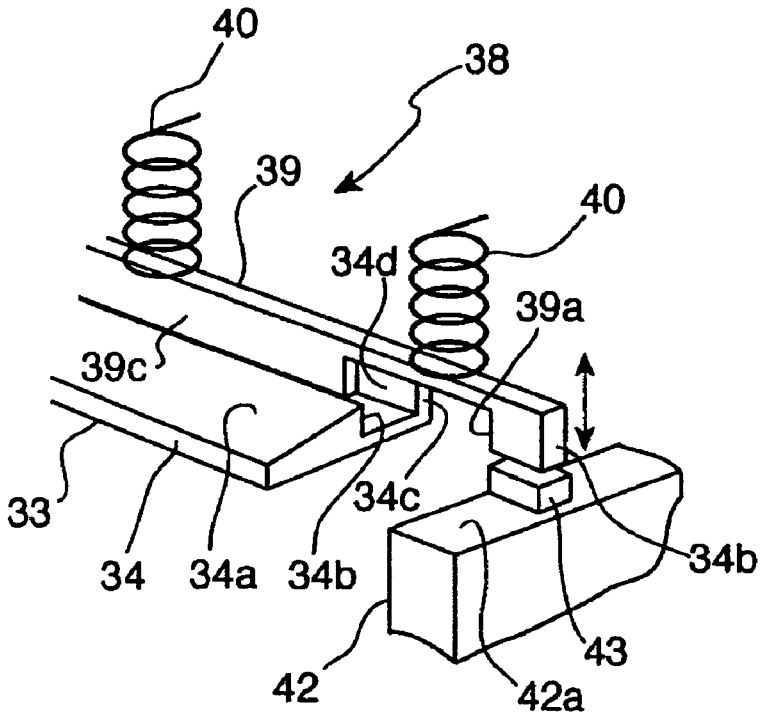
FIG. 20 is a perspective view schematically showing the stabilization base, lock means, and the mount base.
Figure 21:
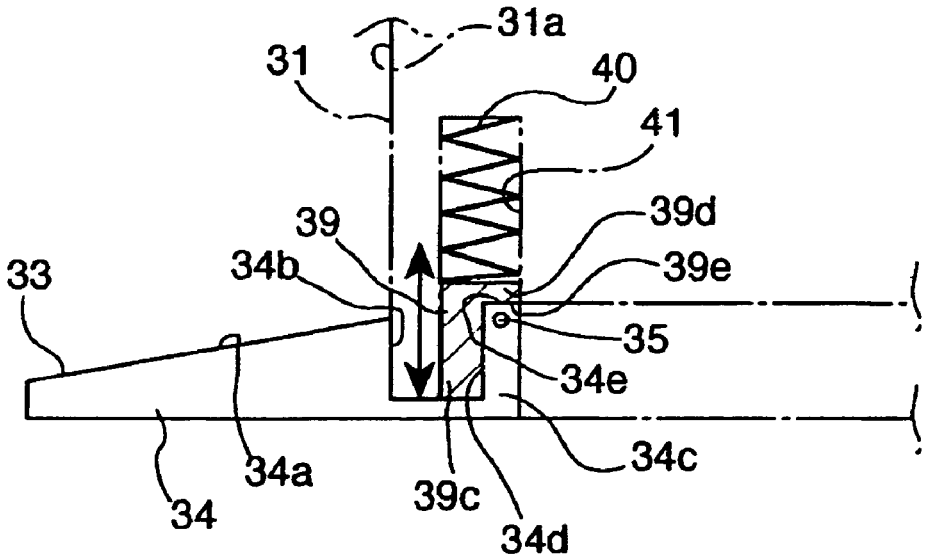
FIG. 21 schematically shows how the stabilization base is locked in the use position by the lock means, as viewed from a lateral side.

As shown in FIGS. 19 to 21, the base main body 34 is in a wedge-like shape whose thickness in the vertical direction is greater at the rear end than at the front end, in vertical section. In addition, an upper surface 34*a* of the base main body 34 is provided with an engaging groove 34*b* extending from the left end to the right end, at a position near the rear end of the upper surface 34*a*.

As shown in FIGS. 18 and 19, the support shaft 35 is fixed to the base main body 34 in the state of being inserted through the base main body 34 in the left-right direction at an upper end portion of a rear-side portion (rear end portion) 34*c* of the engaging groove 34*b*. Tip end portions of a left end portion 35*a* and a right end portion 35*b* projected respectively to the left and right sides from the left and right end faces of the base main body 34 are turnably supported in support holes 36*b*, 36*b* provided in left and right side walls 36*a*, 36*a* in the storing recessed portion 36. This results in that the base main body 34 is supported so that it can be turned in the direction of arrow A or in the direction of arrow B in FIG. 19, relative to the apparatus main body 31.

The base main body 34 is thus supported to be turnable relative to the apparatus main body 31 through the support shaft 35. Thus, the stabilization base 33 in the video display apparatus 30 can be moved, through turning, between a use position and a storage position. The use position (the condition shown in FIG. 16, or the condition indicated by two-dotted chain line in FIG. 18) is a position where the stabilization base 33 is projected forwards (outwards) in relation to the front surface (outer edge) 31*a* of the apparatus main body 31. The storage position (the condition shown in FIG. 17, or the condition indicated by solid line in FIG. 18) is a position where the stabilization base 33 is stored in the storing recessed portion 36 in the apparatus main body 31 and located on the inner side (inwards) in relation to the front surface 31*a*.

In addition, coil springs 37, 37 are fitted over the left end portion 35*a* and the right end portion 35*b*, which are projected respectively to the left side and the right side from the base main body 34, of the support shaft 35. As shown in FIG. 18, one end portion 37*a* of the coil springs 37, 37 is engaged and fixed to the base main body 34, while the other end portion 37*b* is engaged and fixed to the side wall 36*a* of the storing recessed portion 36. This results in that the coil springs 37, 37 normally urge the stabilization base 33 in the direction (the direction of arrow B in FIG. 19) for turning from the storage position toward the use position.

Meanwhile, the use position of the stabilization base 33 is a position for preventing the apparatus main body 31 from turning over when the video display apparatus 30 is installed. Therefore, it is necessary to prevent the stabilization base 33 from easily moving from the use position, even when some force is exerted thereon. Accordingly, the video display apparatus 30 is provided with lock means 38 for immovably locking the stabilization base 33 in the use position.

As shown in FIGS. 18 and 20, the lock means 38 is provided at a position near the front end of the storing recessed portion 36. As schematically shown in FIG. 20, the lock means 38 includes an engaging member 39, and coil springs 40, 40 for urging the engaging member 39 downwards.

Figure 22:
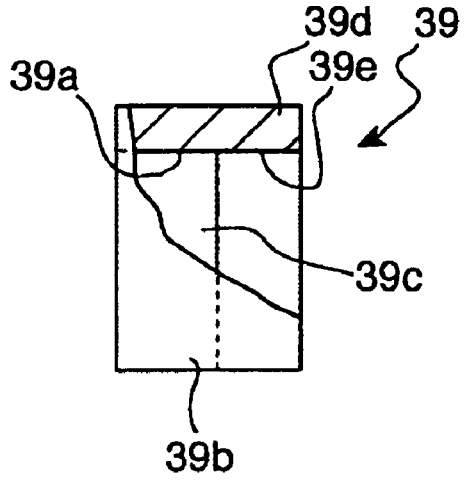
FIG. 22 is an enlarged side view of an engaging member, partly cut out.

As shown in FIGS. 18 and 22, the engaging member 39 is formed in a plate-like shape of which the overall shape is elongate in the left-right direction and the plane direction is in the front-rear direction. The engaging member 39 is provided with cutouts 39*a*, 39*a* in a rectangular shape elongate in the left-right direction, at positions near both ends thereof. The engaging member 39 as a whole is divided into three portions, namely, pressed portions 39*b*, 39*b* located on the outside of the cutouts 39*a*, 39*a*, and an engaging portion 39*c* consisting of the portion between the cutouts 39*a*, 39*a*. In addition, the engaging portion 39*c* is integrally provided at its upper end portion with an engaging projected portion 39*d* projected rearwards.

Figure 23:
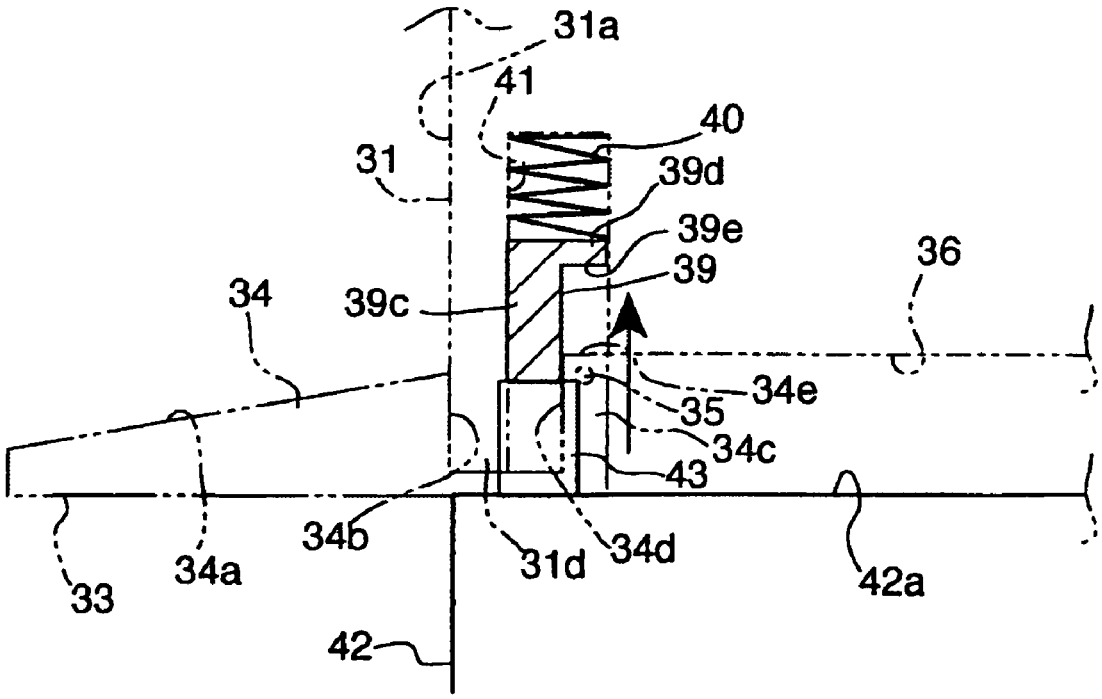
FIG. 23 schematically shows the condition where the locking of the stabilization base in the use position is canceled, as viewed from a lateral side.

As schematically shown in FIGS. 20, 21 and 23, the engaging member 39 is arranged in an arranging recessed portion 41 provided to open in the lower surface 31*c* of the apparatus main body 31, in such a manner that it can be slid in the vertical direction.

In addition, as shown in FIGS. 20 and 21, the coil springs 40, 40 are disposed in the contracted state between the upper surface of the engaging member 39 and the upper surface of the arranging recessed portion 41, in the arranging recessed portion 41 in which the engaging member 39 is arranged. Consequently, the engaging portion 39 is normally urged downwards. The engaging member 39 thus normally urged downwards by the coil springs 40, 40 is prevented from slipping off from the arranging recessed portion 41, by appropriate means which is not shown.

Incidentally, when the stabilization base 33 is in the use position, a part 31 of an outer casing of the apparatus main body 31 is inserted in a front half portion of the engaging groove 34*b* of the base main body 34. At the same time, an engaging portion 39*c* of the engaging member 39 is inserted in a rear half portion of the engaging groove 34*b*, as shown in FIG. 21. In this instance, the front surface of the part 31*d* of the outer casing of the apparatus main body 31 makes contact with the front surface of the engaging groove 34*b*, while the rear surface of the engaging portion 39*c* makes contact with the rear surface 34*d* of the engaging groove 34*b*. In addition, a lower surface 39*e* of the engaging projected portion 39*d* of the engaging member 39 makes springy contact with the upper surface 34*e* of the rear end portion 34*c* of the base main body 34.

Therefore, as shown in FIG. 21, the stabilization base 33 is in the following state. The rear surface of the engaging portion 39*c* and the lower surface 39*e* of the engaging projected portion 39*c* which are orthogonal to each other, of the engaging member 39 urged downwards by the coil springs 40, 40, are in engagement with the rear surface 34*d* of the engaging groove 34*b* and the upper surface 34*e* of the rear end portion 34*c* continuous therewith which are orthogonal to each other. Since the lower surface 39*e* of the engaging projected portion 39*d* is in contact with the upper surface 34*e* of the rear end portion 34*c* of the base main body 34, when the stabilization base 33 is going to turn in the direction of arrow A in FIG. 19, an otherwise possible upward movement of the upper surface 34*e* of the rear end portion 34*c* of the base main body 34 is blocked by the lower surface 39*e* of the engaging projected portion 39*d*. Therefore, the stabilization base 33 is prevented from turning in the direction of arrow A in FIG. 19, or turning from the use position toward the storage position. Accordingly, the stabilization base 33 is immovably locked in the use position.

In addition, the stabilization base 33 is normally urged by the coil springs 37, 37. Consequently, the stabilization base 33 can also be turned upwards beyond the use position against the urging forces of the coil springs 40, 40 exerted through the engaging member 39 of the lock means 38. However, the part 31*d* of the outer casing of the apparatus main body 31 is inserted in the front half portion of the engaging groove 34*b* in the base main body 34 of the stabilization base 33. Further, the part 31*d* of the outer casing is in contact with the bottom surface and the front surface of the engaging groove 34*b*. Thus, the stabilization base 33 is prevented from turning upwards beyond the use position (see FIG. 23).

Therefore, the stabilization base 33 is prevented from turning in the direction of arrow B in FIG. 19, or turning upwards beyond the use position, by the part 31*d* of the outer casing of the apparatus main body 31. Further, the stabilization base 33 is inhibited from turning in the direction of arrow A in FIG. 19, or turning toward the storage position, by the engaging member 39 of the lock means 38.

The canceling of the locking of the stabilization base 33 by the lock means 38 is achieved by pressing the pressed portions 39*b*, 39*b* of the engaging member 39 upwards by some means.

With the pressed portions 39*b*, 39*b* pressed upwards (see the arrow in FIG. 23), the engaging member 39 is moved upwards. Then, the engaging portion 39*c* is moved upwards out of the engaging groove 34*b* in the base main body 34 of the stabilization base 33. Consequently, the engagements of the rear surface of the engaging portion 39*c* and the lower surface 39*e* of the engaging projected portion 39*d* with the rear surface 34*d* of the engaging groove 34*b* and the upper surface 34*e* of the rear end portion 34*c* continuous therewith are canceled. This canceling of the engagements results in canceling of the locking of the stabilization base 33 in the use position against turning in the direction of arrow A in FIG. 19.

Therefore, in the video display apparatus 30, the stabilization base 33 cannot be moved to the storage position where it is stored in the storing recessed portion 36, unless the locking of the stabilization base 33 is canceled by moving the lock means 38 upwards.

Next, description will be made of an example in which the mount base on which to mount the video display apparatus is provided with unlocking means for canceling the locking of the stabilization base 33 in the use position by the lock means 38.

The video display apparatus 30 is not only used in the state of being installed singly on a floor or the like but also may be mounted on an exclusive-use mount base 42. The exclusive-use mount base 42 is formed to attain a feeling of unity on a design basis with the video display apparatus 30 as shown in FIG. 17.

Though detailed illustration and description are omitted, the mount base 42 has an appropriate structure as below. That is, when the video display apparatus 30 is mounted on the mount base 42, it holds the video display apparatus 30 in a stable installed condition in which the video display apparatus 30 would not easily turn over.

As shown in FIGS. 17, 20 and 23, the mount base 42 includes pressing projections 43, 43 (only one of them is shown) provided at positions near the front end of a mount surface 42*a* on which to mount the video display apparatus 30. Incidentally, to avoid interference with the stabilization base 33 which is moved between the use position and the storage position through turning, the mount base 42 includes a cutout 42*b*. The cutout 42*b* is formed by cutting out its portion corresponding to the storing recessed portion 36 in the condition where the apparatus main body 31 is mounted thereon, over the range from its upper surface (mount surface 42*a*) toward its lower surface. Thus, the mount base 42 as a whole is roughly U-shaped as viewed in the vertical direction.

When the video display apparatus 30 is mounted on the mount base 42, the pressing projections 43, 43 press the pressed portions 39*b*, 39*b* of the engaging member 39 of the lock means 38 upwards. Accordingly, the locking of the stabilization base 33 by the lock means 38 is canceled (see FIG. 23).

In addition, as shown in FIGS. 18 and 19, holding means 44 is provided at an upper end portion of the rear surface, corresponding to the rear end of the storing recessed portion 36 of the apparatus main body 31, of the cutout 42*b* at an upper portion of the mount base 42. The holding means 44 inhibits the stabilization base 33 from turning and fixes the stabilization base 33 in the storage position.

The holding means 44 is composed of a holding member 45, and a coil spring 46 for urging the holding member 45 forwards.

The holding means 44 is, for example, arranged in a holding hole 47 formed in the upper end portion of the rear surface of the cutout 42*b* in the mount base 42, in a condition where the holding member 45 can be moved in the front-rear direction. The coil spring 46 is disposed in a contracted state between the holding member 45 and the rear surface of the holding hole 47. Thus, the holding member 45 is normally urged forwards.

As shown in FIG. 19, the front surface 45*a* of the holding member 45 is formed as a slant surface which is gradually deviated upwards as one goes forwards.

When the stabilization base 33 is moved to the storage position, the front end of the holding member 45 is located on the front side relative to the tip end of the base main body 34. In addition, the upper surface 34*a* of the base main body 34 comes into contact with the upper surface 45*b* of the holding member 45 from the upper side. Consequently, the base main body 34 is inhibited from turning in the direction of arrow B in FIG. 19.

Specifically, as the stabilization base 33 is turned from the use position toward the storage position, a tip end portion of the base main body 34 makes contact with the front surface 45*a* of the holding member 45 of the holding means 44 immediately before the position of the stabilization base 33 reaches the storage position. Then, the stabilization base 33 is turned further toward the storage position (in the direction of arrow A in FIG. 19) under the condition where the tip end portion of the base main body 34 is in contact with the front surface 45*a* (which is a slant surface) of the holding member 45. Accordingly, the tip end portion of the base main body 34 presses the front surface 45*a* of the holding member 45 upwards, whereby the tip end portion of the base main body 34 gradually slides on the front surface 45*a* upwards. Simultaneously, the front surface 45*a* of the holding member 45 is pushed rearwards by the tip end portion, so that the holding member 45 is moved rearwards.

Then, when the stabilization base 33 reaches the storage position, the contact between the tip end portion of the base main body 34 and the front surface 45*a* of the holding member 45 is released. Further, the holding member 45 is returned into its initial position (the position where it is projected most to the front side) under the urging force exerted by the coil spring 46. In this condition, a front end portion of the holding member 45 is located on the lower side of the tip end portion of the base main body 34. Therefore, the upper surface 34*a* of the base main body 34 and the upper surface 45*b* of the holding member 45 make contact with each other. Thus, the base main body 34 is blocked from turning toward the use position, and the stabilization base 33 is immovably held in the storage position.

Then, when the video display apparatus 30 is lifted up from the mount base 42, the locking of the base main body 34 in the storage position by the holding member 45 provided in the mount base 42, for preventing the base main body 34 from turning in the direction of arrow B in FIG. 19, is canceled. Therefore, the base main body 34 is turned in the direction of arrow B in FIG. 19, i.e., in the direction from the storage position toward the use position under the urging forces exerted by the coil springs 37, 37, and the stabilization base 33 is automatically moved to the use position. The base main body 34 thus turned to the use position is inhibited from turning upwards beyond the use position, since the part 31*d* of the outer casing of the apparatus main body 31 is engaged with the engaging groove 34*b*. Simultaneously, the engaging portion 39*c* of the engaging member 39 of the lock means 38 is inserted into the engaging groove 34*b*. Then, the rear surface of the engaging portion 39*c* comes into contact with the rear surface 34*d* of the engaging groove 34*b*. In addition, the upper surface 34*e* of the rear end portion 34*c* of the base main body 34 comes into contact with the lower surface 39*e* of the engaging projected portion 39*d* of the engaging member 39. Thus, the base main body 34 in the use position is inhibited from turning in the direction of arrow A or arrow B in FIG. 19.

As has been described above, the stabilization base 33 is immovably locked in the use position by the lock means 38 provided in the apparatus main body 31. The canceling of the locking is effected only by pressing the lock means 38 from the lower side. Therefore, in the case where the video display apparatus 30 is installed singly on a floor surface or the like, the stabilization base 33 is prevented from moving from the use position to the storage position. Thus, the video display apparatus 30 is prevented from turning over, so that the video display apparatus 30 is held in a stable installed condition.

Incidentally, in the video display apparatus 30 also, the canceling of the locking of the stabilization base 33 may not necessarily be achieved by the upward pressing by the pressing projections 43, 43 provided in the mount base 42, but may be effected by pressing from one of the front, rear, left, and right sides by appropriate means.

Next, description will be made of an exhibiting method for exhibiting the video display apparatus with stabilization base which has been described in each of the above embodiments, for sale in a store or for the like purposes.

The exhibiting method is for making it possible to exhibit the video display apparatus in the condition where the height from the grounding surface to the center of the screen for displaying video images is adjusted to a position suited to video display characteristics, without being affected by the size of the screen.

Though not shown in figures, the video display apparatus to which the following exhibiting method is applied is naturally provided at its grounding portion with a stabilization base. The stabilization base just mentioned is movable between a use position where it is projected outwards in relation to an outer edge of the grounding portion and a storage position where it is stored on the inner side in relation to the outer edge.

In the video display apparatus exhibiting method, a plurality of kinds of mount bases differing in the height from grounding surface to mount surface are prepared. Some of the plurality of kinds of mount bases are used in an appropriate combination, and a video display apparatus is mounted on the uppermost mount surface. Thus, the height from the grounding surface to the center of the screen of the video display apparatus is set to a desired height without being affected by the size of the screen of the video display apparatus. Incidentally, the mount base is not limited to the one used at the time of using the video display apparatus and generally called mount stand or the like, but includes bases used only at the time of exhibition which will be described later.

The present exhibiting method, principally, is intended to be applied to a rear projection type video display apparatus. Specifically, a rear projection type video display apparatus has such a characteristic that the range in which the images displayed on the screen can be recognized normally (the range will hereinafter be referred to as "angle of visibility") is as narrow as 30 to 40°. In view of the above-described characteristic, this exhibiting method is aimed at alleviation of the influences of the narrow angle of visibility.

In the rear projection type video display apparatuses, the angle of visibility of the screen is narrow as mentioned above. Consequently, there has been the problem that even a slight deviation of the visual point from the angle of visibility results in that the images displayed on the screen cannot be recognized normally and that the screen may be erroneously recognized as displaying nothing. Accordingly, there has been the problem that the intrinsic high-image-quality display performance of the screen is not adequately evaluated. In view of this, the exhibiting method according to the present invention is intended to ensure that the height from the grounding surface to the center of the screen for displaying video images of the video display apparatus is adjusted to the height of the eyes of the viewer irrespectively of the size of the screen. Thus, the following problem of the rear projection type video display apparatus may be solved. Specifically, the problem that even a slight deviation of the visual point from the angle of visibility makes it impossible to normally recognize the video images displayed on the screen, due to the narrow angle of visibility of the screen, may be solved Now, the details of the video display apparatus exhibiting method according to the present invention will be described below.

As an example of the video display apparatus exhibiting method, the case of exhibiting video display apparatuses 50A, 50B, and 50C will be described referring to FIGS. 24 and 25. The video display apparatuses 50A, 50B, and 50C include screens having sizes of 42, 50, and 60 inches, respectively.

The video display apparatuses 50A, 50B, and 50C with the screens differing in size will differ in the height from grounding surface to screen center when they are each installed singly on a floor or the like. For example, in the case of the video display apparatuses 50A, 50B, and 50C as above-mentioned, the heights are 48, 60, and 68 cm, respectively.

The video display apparatuses 50A, 50B, and 50C, in use, are installed singly and directly on a floor or the like, or are mounted on mount bases 51, 52 which are each a kind of mount base, according to the size thereof. The mount stands 51 and 52 are so designed that the heights from the grounding surface to the mount surfaces 51*a*, 52*a* are both about 40 cm, but the mount stands 51 and 52 differ in left-right width as viewed from the front side, i.e., the mount stand 51 is smaller than the mount stand 52 in left-right width.

The mount stand 51 is used for the video display apparatus 50A having a screen size of 42 inches. The mount stand 52 is used for the video display apparatuses 50B and 50C having screen sizes of 50 and 60 inches.

Meanwhile, the height of the eyes of standing viewers is considered to be about 140 to 150 cm on average. When customers look at commercial products such as video display apparatuses in a store or the like, most of the customers look at them in a standing state. Therefore, at the time of exhibiting the video display apparatuses 50A, 50B, and 50C in a store or the like, the heights from the grounding surface to the centers of the screens are set to about 140 to 150 cm.

Accordingly, the heights of the eyes of the standing customers can be set to within the range of the angle of visibility of 30 to 40°, of the screens of the video display apparatuses 50A, 50B, and 50C. Thus, the video images displayed on the screens of the video display apparatuses 50A, 50B, and 50C are recognized in the normal condition.

Figure 24:
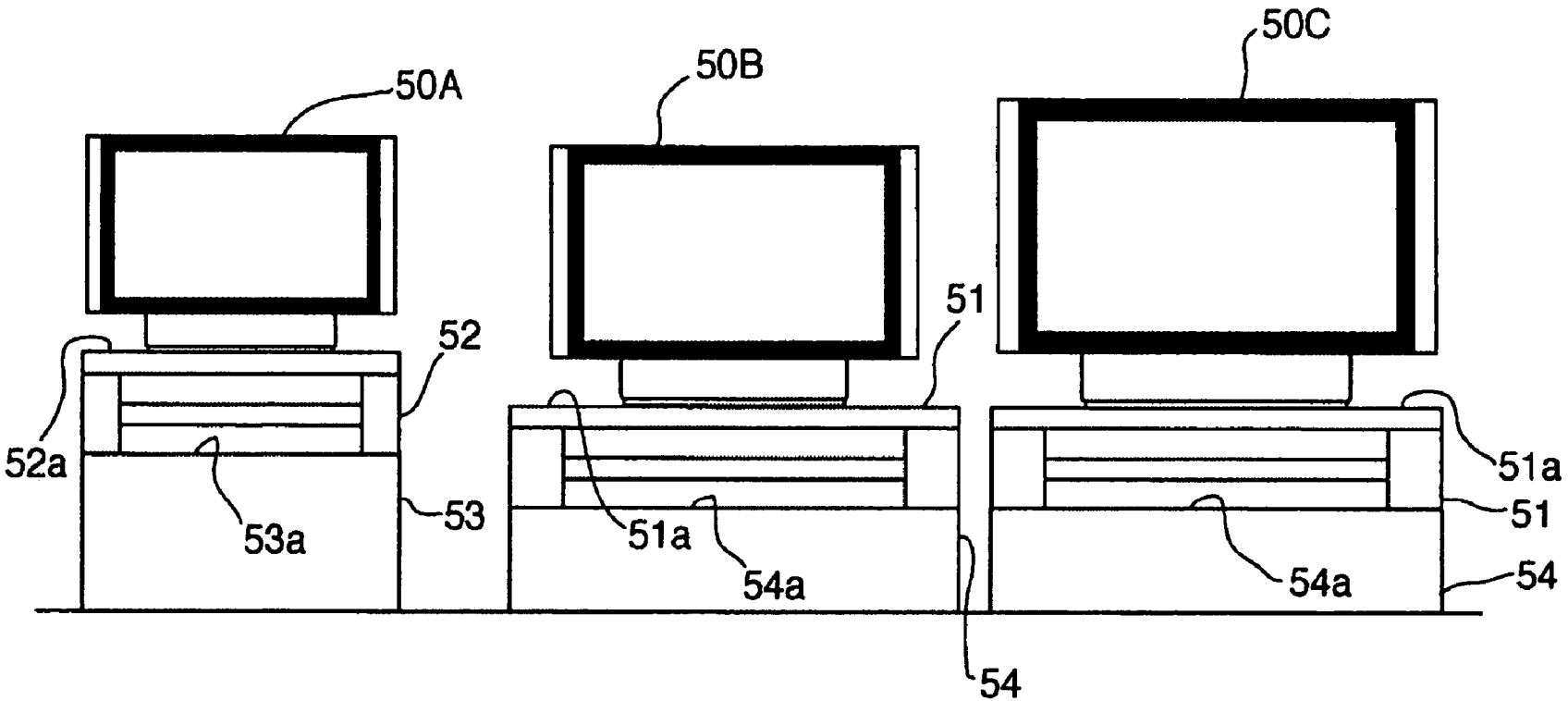
FIG. 24 illustrates an example of a video display apparatus exhibiting method according to the present invention.
Figure 25:
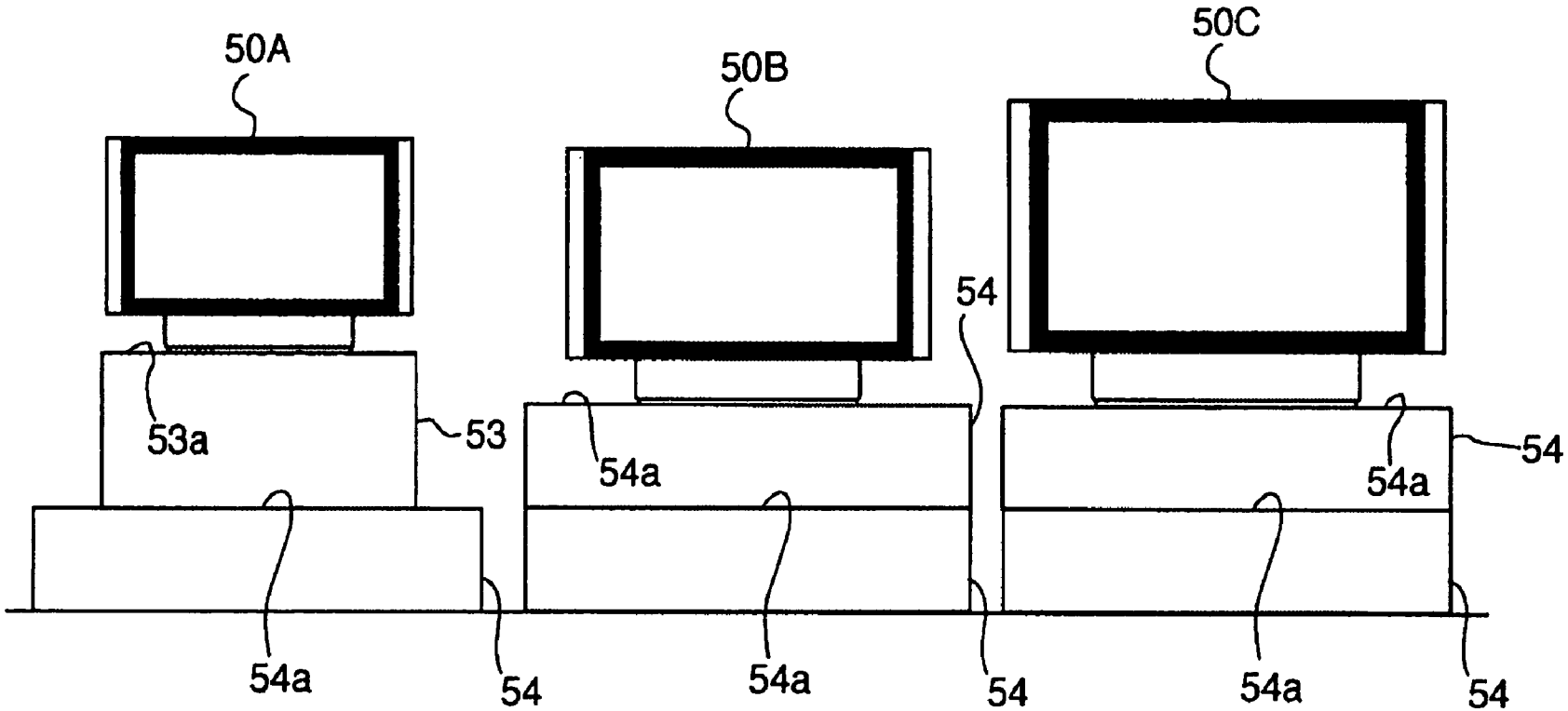
FIG. 25 illustrates another example of the video display apparatus exhibiting method according to the present invention.
Figure 26:
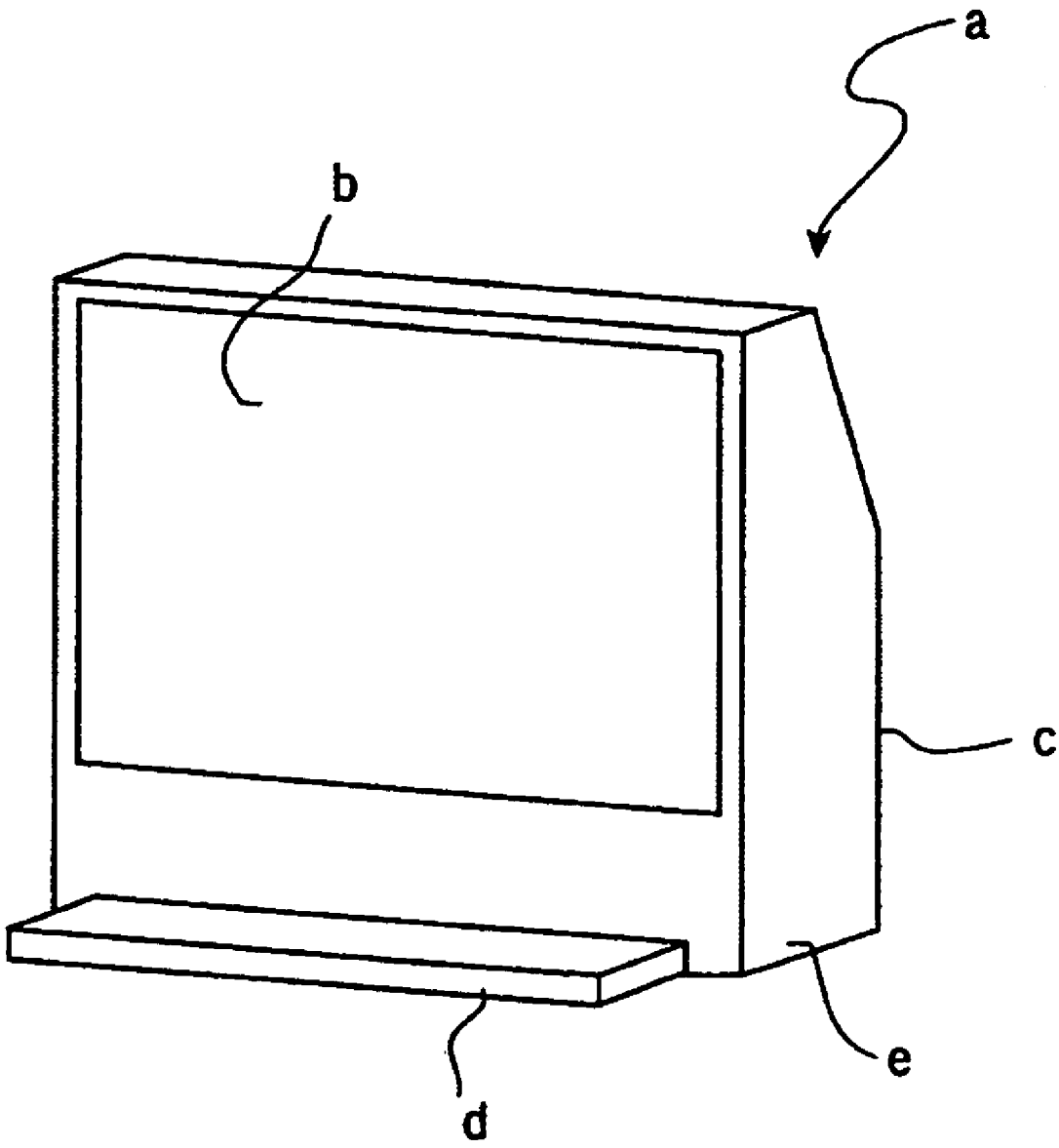
FIG. 26 is a perspective view showing an example of a video display apparatus according to the related art.

From this point of view, according to the video display apparatus exhibiting method of the present invention, as shown in FIGS. 24 and 25, at the time of exhibiting the video display apparatuses 50A, 50B, and 50C, a plurality of kinds of mount bases differing in the height from grounding surface to mount surface are prepared, and some of the plurality of kinds of mount bases are used in an appropriate combination. Consequently, the heights from the installation surface to the centers of the screens of the video display apparatuses 50A, 50B, and 50C can be set to within the range of 140 to 150 cm corresponding to the heights of the eyes of the standing customers.

Besides, as the plurality of kinds of mount bases differing in the height from grounding surface to mount surface, not only the mount stands 51 and 52 but also bases 53 and 54 differing in the height from grounding surface to mount surface and being used only for exhibition are used (see FIG. 24).

As shown in FIG. 24, the mount stand 51 and the base 53 having a height from grounding surface to mount surface 53*a* of about 60 cm are used for the video display apparatus 50A having a screen size of 42 inches. The mount stand 52 and the base 54 having a height from grounding surface to mount surface 54*a* of about 40 cm are used for each of the video display apparatuses 50B and 50C having screen sizes of 50 and 60 inches.

In addition, where only the bases 53 and 54 are to be used, one base 53 and one base 54 are used for the video display apparatus 50A having a screen size of 42 inches, and two bases 54, 54 are used for each of the video display apparatuses 50B and 50C having screen sizes of 50 and 60 inches, as shown in FIG. 25.

Therefore, in each of the case of using the mount stand 51 or 52 with the base 53 or 54 and the case of using the bases 53 and 54 in combination, the height from grounding surface to screen center for the video display apparatus 50A is 148 cm, the height from grounding surface to screen center for the video display apparatus 50B is 140 cm, and the height from grounding surface to screen center for the video display apparatus 50C is 148 cm (see FIGS. 24 and 25). As a result, the video display apparatuses 50A, 50B, and 50C can be installed in such a manner that the heights from grounding surface to screen center are set within the range of 140 to 150 cm.

Incidentally, the video display apparatuses 50A, 50B, and 50C are provided with respective stabilization bases (not shown) for preventing them from turning over and thereby keeping them in stable installed conditions. When the stabilization bases are unnecessary, as in the case of mounting the video display apparatuses on the above-mentioned mount bases, the stabilization bases are stored in such positions as not to constitute obstacles by use of appropriate storing structures.

In addition, an example in which the video display apparatus exhibiting method according to the present invention is applied to an exhibiting method for solving the problems involved in the rear projection type video display apparatuses has been described above. However, the video display apparatus exhibiting method of the present invention is applicable not only to the rear projection type video display apparatuses but also to other types of video display apparatuses such as video display apparatuses using liquid crystal display panels, etc.

Further, an example in which the video display apparatus exhibiting method according to the present invention is used for adjusting the heights of screen centers of video display apparatuses to the heights of the eyes of standing viewers in the case of exhibiting the video display apparatuses in a store or the like has been illustrated in the above description. However, the video display apparatus exhibiting method of the present invention is widely applicable not only to the above-described example but also to video display apparatus exhibiting methods in which the height from grounding surface to screen center of a video display apparatus is adjusted to a desired height.

Furthermore, an example in which the mount stands 51, 52 and the bases 53, 54 are used as mount bases for mounting video display apparatuses thereon has been illustrated in the above description. However, the mount bases for mounting the video display apparatuses thereon are not limited to these mount stands and bases. Any mount base by which the heights from grounding surface to screen centers of video display apparatuses can be set to desired heights at the time of exhibiting the video display apparatuses may be used.

The specific shapes and structures of individual component parts shown in each of the above embodiments are mere examples of embodiment for carrying out the present invention. Therefore, they are not to be construed as limitative of the technical scope of the invention.

As is clear from the above description, the device with stabilization base according to the present invention includes a stabilization base provided at a grounding portion of a device main body for stabilizing the installed condition of the device main body and preventing the device main body from turning over. The stabilization base is movable between a use position where it is projected outwards in relation to the grounding portion and a storage position where it is stored in a storing portion provided in the grounding portion. The stabilization base in the use position is immovably locked by lock means provided in the device main body, and the locking by the lock means is canceled by pressing from the lower side or a lateral side.

Therefore, in the device with stabilization base according to the present invention, the stabilization base in the use position can be locked by the lock means so as not to easily move. Meanwhile, when no problem occurs even if the stabilization base is moved, the locking of the stabilization base in the use position can be easily canceled by, for example, use of appropriate means for pushing the lock means from the lower side or a lateral side. Accordingly, for example in the case where the device with stabilization base is mounted on a mount base or on other device, by providing pressing means for pressing the lock means in the mount base or the other device, the locking of the stabilization base in the use position can be easily canceled by only mounting the device on the mount base or the other device.

In the present invention, the stabilization base is provided with an engaging portion. The engaging portion is moved to a predetermined position when the stabilization base is moved into the storage position. Therefore, for example in the case where the device is mounted on the mount base or where a plurality of devices are used in a stacked condition, by providing, in the mount base or in each of the devices, an engaging portion for engagement with the engaging portion of the stabilization base, the device and the mount base or the plurality of devices can be connected to each other through the stabilization base(s), and the device and the mount base or the plurality of devices as a whole can be installed in a stable condition.

In the present invention, the stabilization base is attached to a device main body so that it is movable between the use position and the storage position through sliding. Thus, the structure for movement of the stabilization base can be simplified, and the stabilization base can be moved easily.

In the present invention, the stabilization base is attached to a device main body so that it is movable between the use position and the storage position through turning. Thus, the structure for movement of the stabilization base can be simplified, and the stabilization base can be moved easily.

In addition, the video display apparatus according to the present invention includes a stabilization base provided at a grounding portion of an apparatus main body containing required various components therein. The stabilization base stabilizes the installed condition of the apparatus main body and prevents the apparatus main body from turning over. The stabilization base is movable between a use position where it is projected outwards in relation to the grounding portion and a storage position where it is stored in a storing portion provided in the grounding portion. The stabilization base in the use position is immovably locked by lock means provided in the apparatus main body, and the locking by the lock means is canceled by pressing from the lower side or a lateral side.

In the video display apparatus of the present invention, therefore, the stabilization base in the use position can be locked by the lock means so as not to move easily. Meanwhile, when no problem occurs even if the stabilization base is moved, the locking of the stabilization base in the use position can be easily canceled by, for example, use of appropriate pressing means for pressing the lock means from the lower side or a lateral side. Accordingly, for example in the case where the video display apparatus is mounted on a mount base or on other video display apparatus, by providing pressing means for pressing the lock means in the mount base or the other video display apparatus, the locking of the stabilization base in the use position can be easily canceled by only mounting the video display apparatus on the mount base or the other video display apparatus.

In the present invention, the stabilization base is provided with an engaging portion. The engaging portion is moved to a desired position when the stabilization base is moved into the storage position. Therefore, for example in the case where the video display apparatus is mounted on a mount base or where a plurality of video display apparatuses are used in a stacked condition, by providing, in the mount base or in each of the video display apparatuses, an engaging portion for engagement with the engaging portion of the stabilization base, the video display apparatus and the mount base or the plurality of video display apparatuses can be connected to each other through the stabilization base(s), and the video display apparatus and the mount base or the plurality of the video display apparatuses as a whole can be installed in a stable state.

In the present invention, the stabilization base is attached to an apparatus main body so that it is movable between the use position and the storage position through sliding. Thus, the structure for movement of the stabilization base can be simplified, and the stabilization base can be moved easily.

In the present invention, the stabilization base is attached to an apparatus main body so that it is movable between the use position and the storage position through turning. Thus, the structure for movement of the stabilization base can be simplified, and the stabilization base can be moved easily.

Besides, the device with stabilization base according to the present invention includes a stabilization base provided at a grounding portion of a device main body. The stabilization base stabilizes the installed condition of the device main body and prevents the device main body from turning over. The stabilization base is movable between a use position where it is projected outwards in relation to the grounding portion and a storage position where it is stored in a storing portion provided in the grounding portion. The stabilization base in the use position is immovably locked by lock means provided in the device main body. The stabilization base includes an engaging portion which is moved to a predetermined position when the stabilization base is moved into the storage position. A mount base for the device according to the present invention includes, at a mount surface thereof, projected unlocking means for canceling the function of the lock means, and an engaged portion corresponding to the engaging portion located at the predetermined position.

Therefore, in the device with stabilization base and the like according to the present invention, when a plurality of the devices of the present invention are stacked, the locking by the lock means for the stabilization bases in the second-lowest and upper devices is canceled. By moving these stabilization bases into the respective storage positions, the plurality of the devices of the present invention can be connected to each other with the stabilization bases moved into the storage positions.

In addition, the device exhibition system according to the present invention includes a device including a stabilization base provide at a grounding portion of a device main body and a device mount base on which to mount the device with stabilization base. The stabilization base stabilizes the installed condition of the device main body and prevents the device main body from turning over. The device mount base includes a mount surface having substantially the same shape as the grounding portion of the device with the stabilization base. The stabilization base of the device with stabilization base is movable between a use position where it is projected outwards in relation to the grounding portion and a storage position where it is stored in a storing portion provided in the grounding portion. The stabilization base in the use position is immovably locked by lock means provided in the device main body. The locking by the lock means is canceled by pressing from the lower side. The stabilization base is provided with an engaging portion which moves to a predetermined position when the stabilization base is moved into the storage position. The mount surface of the device mount base is provided with projected unlocking means for canceling the lock means and an engaged portion corresponding to the engaging portion located at the predetermined position. The locking is canceled by the unlocking means when the device with stabilization base is mounted on the device mount base, and, when the stabilization base is moved into the storage position, the engaging portion is engaged with the engaged portion. Thus, the device with stabilization base and the device mount base are connected to each other.

Therefore, in the device exhibiting system of the present invention, when the device with stabilization base is mounted on the device mount base, the lock means for the stabilization base of the device is canceled. By moving the stabilization base into the storage position, the device with stabilization base and the device mount base can be connected to each other with the stabilization base moved into the storage position.

Besides, the video display apparatus with stabilization base of the present invention includes a stabilization base provided at a grounding portion of an apparatus main body containing required various elements therein. The stabilization base stabilizes the installed condition of the apparatus main body and prevents the apparatus main body from turning over. The stabilization base is movable between a use position where it is projected outwards in relation to the grounding portion and a storage position where it is stored in a storing portion provided in the grounding portion. The stabilization base in the use position is immovably locked by lock means provided in the apparatus main body. The locking by the lock means is canceled by pressing from the lower side. The stabilization base is provided with an engaging portion which moves to a predetermined position when the stabilization base is moved into the storage position. A mount base for the video display apparatus of the present invention includes, at a mount surface thereof, projected unlocking means for canceling the lock means and an engaged portion corresponding to the engaging portion located at the predetermined position.

Therefore, in the video displaying apparatus and the like according to the present invention, when a plurality of video display apparatuses of the present invention are stacked, the locking means for the stabilization bases in the second-lowest and upper video display apparatuses are canceled. By moving the stabilization bases into respective storage positions, the plurality of video display apparatuses of the present invention can be connected to each other with the stabilization bases moved into the storage positions.

In addition, the video display apparatus exhibition system according to the present invention includes a video display apparatus including a stabilization base and a video display apparatus mount base on which the device with stabilization base is mounted. The stabilization base is provided at a grounding portion of an apparatus main body containing required various elements therein. The stabilization base stabilizes the installed condition of the apparatus main body and prevents the apparatus main body from turning over. The video display apparatus mount base includes a mount surface having substantially the same shape as the grounding portion of the video display apparatus with stabilization base. The stabilization base of the video display apparatus with stabilization base is movable between a use position where it is projected outwards in relation to the grounding portion and a storage position where it is stored in a storing portion provided in the grounding portion. The stabilization base in the use position is immovably locked by lock means provided in the apparatus main body. The locking by the lock means is canceled by pressing from the lower side. The stabilization base includes an engaging portion which moves to a predetermined position when the stabilization base is moved into the storage position. The mount surface of the video display apparatus mount base is provided with projected unlocking means for canceling the lock means and an engaged portion corresponding to the engaging portion located at the predetermined position. The locking is canceled by the unlocking means when the video display apparatus with stabilization base is mounted on the video display apparatus mount base. Meanwhile, when the stabilization base is moved into the storage position, the engaging portion is engaged with the engaged portion. Thus, the video display apparatus with stabilization base and the video display apparatus mount base are connected to each other.

Therefore, in the video display apparatus exhibition system according to the present invention, the lock means for the stabilization base of the video display apparatus with stabilization base is canceled when the video display apparatus is mounted on the video display apparatus mount base. By moving the stabilization base into the storage position, the video display apparatus with stabilization base and the video display apparatus mount base can be connected to each other with the stabilization base moved into the storage position.

The video display exhibiting method according to the present invention enables a video display apparatus to be exhibited with the height from grounding surface to the center of a screen being set to a height suited to video display characteristics without being affected by the size of the screen for displaying video images. A stabilization base movable between a use position where it is projected outwards in relation to a grounding portion of the video display apparatus and a storage position where it is stored in a storing portion provided in the grounding portion is provided at the grounding portion. A plurality of kinds of mount bases differing in the height from grounding surface to mount surface are prepared. Some of the plurality of kinds of mount bases are used in an appropriate combination, and the video display apparatus is mounted on the uppermost mount surface. Thus, the height from a grounding surface to the centers of screens of the video display apparatus is set to a desired height without being affected by the size of the screen.

Therefore, in the video display apparatus exhibiting method according to the present invention, the use of a plurality of kinds of mount bases ensures the following. That is, the height from the grounding surface to the center of the screen of the video display apparatus is set to a desired height without being affected by the size of the screen of the video display apparatus. Accordingly, the height from a grounding surface to the center of the screen of the video display apparatus can be set to a desired height. For example, the video display apparatus can be exhibited in the condition where the height from the grounding surface to the center of the screen is adjusted to the height of the eyes of standing viewers.

The invention claimed is:

1. A device with a stabilization base provided at a grounding portion of a device main body so as to stabilize the condition of said device main body and to prevent said device main body from turning over when said device main body is installed, wherein said stabilization base is movable between a use position where said stabilization base is projected outwards relative to said grounding portion and a storage position where said stabilization base is stored in a storing portion provided in said grounding portion, and said stabilization base is immovably locked in said use position by lock means provided in said device main body, and, when said device main body is mounted on a mount surface of a mount base including projected unlocking means at said mount surface, the locking by said locking means is canceled by pressing from the lower side by said unlocking means.

2. A device with a stabilization base as set forth in claim 1, wherein said stabilization base is provided with an engaging portion, and said engaging portion moves to a predetermined position when said stabilization base is moved into said storage position.

3. A device with a stabilization base as set forth in claim 1, wherein said stabilization base is mounted to said device main body so as to be movable by sliding between said use position and said storage position.

4. A device with a stabilization base as set forth in claim 1, wherein said stabilization base is mounted to said device main body so as to be movable by turning between said use position and said storage position.

5. A video display apparatus with a stabilization base provided at a grounding portion of an apparatus main body containing required various elements in the apparatus main body so as to stabilize an installed condition of said apparatus main body and to prevent said apparatus main body from turning over, wherein said stabilization base is movable between a use position where said stabilization base is projected outwards relative to said grounding portion and a storage position where said stabilization base is stored in a storing portion provided in said grounding portion, and said stabilization base is immovably locked in said use position by lock means provided in said apparatus main body, and, when said apparatus main body is mounted on a mount surface of a mount base including projected unlocking means at said mount surface, the locking by said lock means is canceled by pressing from the lower side by said unlocking means.

6. A video display apparatus as set forth in claim 5, wherein said stabilization base is provided with an engaging portion, and said engaging portion moves to a predetermined position when said stabilization base is moved into said storage position.

7. A video display apparatus as set forth in claim 5, wherein said stabilization base is mounted to said apparatus main body so as to be movable by sliding between said use position and said storage position.

8. A video display apparatus as set forth in claim 5, wherein said stabilization base is mounted to said apparatus main body so as to be movable by turning between said use position and said storage position.

9. A device with a stabilization base provided at a grounding portion of a device main body so as to stabilize the condition of said device main body and to prevent said device main body from turning over when said device main body is installed, wherein said stabilization base is movable between a use position where said stabilization base is projected outwards relative to said grounding portion and a storage position where said stabilization base is stored in a storing portion provided in said grounding portion, said stabilization base is immovably locked by lock means provided in said device main body, the locking by said lock means is canceled by pressing from the lower side, said stabilization base is provided with an engaging portion which moves to a predetermined position when said stabilization base is moved into said storage position, and projected unlocking means for canceling said lock means and an engaged portion corresponding to said engaging portion at said predetermined position are provided at an upper surface of said device main body.

10. A device mount base which comprises a mount surface having substantially the same shape as a grounding portion of a device with a stabilization base provided in said grounding portion of a device main body so as to stabilize the condition of said device main body and to prevent said device main body from turning over when said device main body is installed and on which said device with said stabilization base is to be mounted, wherein said stabilization base of said device with said stabilization base is movable between a use position where said stabilization base is projected outwards relative to said grounding portion and a storage position where said stabilization base is stored in a storing portion provided in said grounding portion, said stabilization base is immovably locked in said use position by lock means provided in said device main body, the locking by said lock means is canceled by pressing from the lower side, said stabilization base is provided with an engaging portion which moves to a predetermined position when said stabilization base is moved into said storage position, and projected unlocking means for canceling said lock means and an engaged portion corresponding to said engaging portion at said predetermined position are provided at said mount surface.

11. A device exhibition system comprising:

a device with a stabilization base provided at a grounding portion of a device main body so as to stabilize the condition of said device main body and to prevent said device main body from turning over when said device main body is installed; and a device mount base which includes a mount surface having substantially the same shape as said grounding portion of said device with said stabilization base and on which said device with said stabilization base is to be mounted, wherein said stabilization base of said device with said stabilization base is movable between a use position where said stabilization base is projected outwards relative to said grounding portion and a storage position where said stabilization base is stored in a storing portion provided in said grounding portion, said stabilization base is immovably locked in said use position by lock means provided in said device main body, the locking by said lock means is canceled by pressing from the lower side, said stabilization base is provided with an engaging portion which moves to a predetermined position when said stabilization base is moved into said storage position, said mount surface of said device mount base is provided with projected unlocking means for canceling said lock means and an engaged portion corresponding to said engaging portion at said predetermined position, when said device with said stabilization base is mounted on said device mount base, said locking is canceled by said unlocking means, and when said stabilization base is moved into said storage position, said engaging portion is engaged with said engaged portion, whereby said device with said stabilization base and said device mount base are connected to each other.

12. A video display apparatus comprising a stabilization base provided at a grounding portion of an apparatus main body containing required various elements in the apparatus main body so as to stabilize the condition of said apparatus main body and to prevent said apparatus main body from turning over when said apparatus main body is installed, wherein said stabilization base is movable between a use position where said stabilization base is projected outwards relative to said grounding portion and a storage position where said stabilization base is stored in a storing portion provided in said grounding portion, said stabilization base is immovably locked in said use position by lock means provided in said apparatus main body, said locking by said lock means is canceled by pressing from the lower side, said stabilization base is provided with an engaging portion which moves to a predetermined position when said stabilization base is moved into said storage position, and projected unlocking means for canceling said lock means and an engaged portion corresponding to said engaging portion at said predetermined position are provided at an upper surface of said apparatus main body.

13. A video display apparatus mount base which comprises a mount surface having substantially the same shape as a grounding portion of a video display apparatus with a stabilization base provided at said grounding portion of an apparatus main body containing required various elements in the apparatus main body so as to stabilize the condition of said apparatus main body and to prevent said apparatus main body from turning over when said apparatus main body is installed and on which said video display apparatus with said stabilization base is to be mounted, wherein said stabilization base of said video display apparatus with said stabilization base is movable between a use position where said stabilization base is projected outwards relative to said grounding portion and a storage position where said stabilization base is stored into a storing portion provided in said grounding portion, said stabilization base is immovably locked in said use position by lock means provided in said apparatus main body, said locking by said lock means is canceled by pressing from the lower side, said stabilization base is provided with an engaging portion which moves to a predetermined position when said stabilization base is moved into said storage position, and said mount surface is provided with projected unlocking means for canceling said lock means and an engaged portion corresponding to said engaging portion at said predetermined position.

14. A video display apparatus exhibition system comprising:

a video display apparatus with a stabilization base provided at a grounding portion of an apparatus main body containing required various elements in the apparatus main body so as to stabilize the condition of said apparatus main body and to prevent said apparatus main body from turning over when said apparatus main body is installed; and a video display apparatus mount base which includes a mount surface having substantially the same shape as said grounding portion of said video display apparatus with said stabilization base and on which said video display apparatus with said stabilization base is to be mounted, wherein said stabilization base of said video display apparatus with said stabilization base is movable between a use position where said stabilization base is projected outwards relative to said grounding portion and a storage position where said stabilization base is stored in a storing portion provided in said grounding portion, said stabilization base is immovably locked in said use position by lock means, said locking by said lock means is canceled by pressing from the lower side, said stabilization base is provided with an engaging portion which moves to a predetermined position when said stabilization base is moved into said storage position, said mount surface of said video display apparatus mount base is provided with projected unlocking means for canceling said lock means and an engaged portion corresponding to said engaging portion at said predetermined position, when said video display apparatus with said stabilization base is mounted on said video display apparatus mount base, said locking is canceled by said unlocking means, and when said stabilization base is moved into said storage position, said engaging portion is engaged with said engaged portion, whereby said video display apparatus with said stabilization base and said video display apparatus mount base are connected to each other.

* * * * *